US006831621B2

(12) United States Patent
Nakano

(10) Patent No.: US 6,831,621 B2
(45) Date of Patent: Dec. 14, 2004

(54) LIQUID CRYSTAL DISPLAY DEVICE

(75) Inventor: Takao Nakano, Tokyo (JP)

(73) Assignee: NEC-Mitsubishi Electric Visual Systems Corporation, Tokyo (JP)

( * ) Notice: Subject to any disclaimer, the term of this patent is extended or adjusted under 35 U.S.C. 154(b) by 278 days.

(21) Appl. No.: 10/192,535

(22) Filed: Jul. 11, 2002

(65) Prior Publication Data

US 2003/0020677 A1 Jan. 30, 2003

(30) Foreign Application Priority Data

Jul. 27, 2001 (JP) ..... P2001-227920

(51) Int. Cl.[7] ..... G09G 3/36
(52) U.S. Cl. ..... 345/87; 345/102
(58) Field of Search ..... 345/87, 88, 89, 345/90, 92, 94, 98, 99, 100, 102, 150, 589, 593, 600; 349/61

(56) References Cited

U.S. PATENT DOCUMENTS 5,461,397 A * 10/1995 Zhang et al. ..... 345/102
5,953,002 A * 9/1999 Hirai et al. ..... 345/204
6,002,385 A * 12/1999 Silverbrook ..... 345/100
6,285,346 B1 9/2001 Melnik et al. ..... 345/87
6,448,951 B1 9/2002 Sakaguchi et al. ..... 345/88
6,535,195 B1 * 3/2003 Nelson ..... 345/102
6,559,825 B2 * 5/2003 Jacobsen et al. ..... 345/102
2001/0052891 A1 12/2001 Yoshihara et al. ..... 345/102
2001/0054989 A1 * 12/2001 Zavracky et al. ..... 345/8
2002/0008683 A1 1/2002 Makino et al. ..... 345/102
2002/0060662 A1 * 5/2002 Hong ..... 345/102

FOREIGN PATENT DOCUMENTS

EP 0 997 868 A1 5/2000
JP 11-337904 12/1999
JP 2000-028984 1/2000
JP 200-147454 5/2000
JP 2000-199886 7/2000
JP 2000-214827 8/2000

* cited by examiner

*Primary Examiner*—Amare Mengistu
*Assistant Examiner*—Nitin Patel

(57) ABSTRACT

A liquid crystal display device is provided. An image memory (4) stores therein input pixel data ($R_{in}$, $B_{in}$, $G_{in}$) on a frame-by-frame basis. Differencing circuits (23 to 25) calculate respective difference data (($R_{in}$–$G_{pre}$), ($B_{in}$–$R_{in}$), ($G_{in}$–$B_{in}$)) on a pixel-by-pixel basis. Comparator circuits (27, 28, 29) output a pulse when the difference data is greater than a difference level (DLV). Counter memories (30 to 32) perform a counting operation each time the pulse is inputted thereto, and output respective counts (FLN_R, FLN_B, FLN_G) after the counting operation for one line. Comparator circuits (34 to 36) output a pulse to skip flag registers (37 to 39), respectively, when the respective counts are greater than a skip level. Skip flags (SPF_Ri, SPF_Bi, SPF_Gi) corresponding to a current line are set at "1." A gate pulse for the line corresponding to the skip flags "1" is skipped. This reduces the write time of image data.

11 Claims, 24 Drawing Sheets

LIQUID CRYSTAL DISPLAY DEVICE

BACKGROUND OF THE INVENTION

1. Field of the Invention

The present invention relates to a color liquid crystal display device for presenting color display using a backlight which emits light of a plurality of colors.

2. Description of the Background Art

A transmissive liquid crystal display device is a device such that light emitted from a backlight disposed on the backside thereof is transmitted through a liquid crystal panel and is then used to recognize an image. FIG. 25 shows an example of a sectional structure of a liquid crystal panel 100 for use in the transmissive liquid crystal display device. The liquid crystal panel 100 comprises polarizing filters 101, 102, an array substrate 103, a glass substrate 104 with a color filter 106 placed on a surface thereof, the substrates 103 and 104 being disposed in opposed relation to each other between the polarizing filters 101 and 102, and a liquid crystal layer 105 sealed in a space between the substrates 103 and 104. Although not shown, pixel electrodes and active elements are disposed in a matrix on a surface of the array substrate 103, and transparent electrodes opposed to the pixel electrodes are formed between the color filter 106 and the liquid crystal layer 105. A backlight 107 which emits white light 108 is provided on the backside of such a liquid crystal panel 100. The white light 108 is colored when passing through the color filter 106 of the liquid crystal panel 100. As shown in FIG. 26, the color filter 106 has R (red), G (green) and B (blue) colored layers corresponding to each pixel and disposed in a matrix on the glass substrate 104. Each of the colors for each pixel corresponds to one liquid crystal cell.

Also known is another transmissive liquid crystal display device which employs backlights 206R, 206G and 206B for emitting light of three colors R, G and B, respectively, as shown in FIG. 27. A liquid crystal panel 200 shown in FIG. 27 comprises polarizing filters 201, 202, an array substrate 203 and a glass substrate 204 which are disposed in opposed relation to each other between the polarizing filters 201 and 202, and a liquid crystal layer 205 sealed in a space between the substrates 203 and 204. The remaining structure of the liquid crystal panel 200 is substantially similar to the corresponding structure shown in FIG. 25 except that the liquid crystal panel 200 comprises no color filter. The backlights 206R, 206G and 206B disposed on the backside of such a liquid crystal panel 200 are controlled to turn on in a time-shared manner for each emitted color. As shown in FIG. 28, each pixel of the liquid crystal panel 200 corresponds to one liquid crystal cell. Thus, the liquid crystal panel 200 is required to have liquid crystal cells the number of which is one third the number of liquid crystal cells of the liquid crystal panel 100 of the color filter type shown in FIG. 25 under the same specifications. The liquid crystal panel 200 has the advantage of greatly reducing light losses because of the non-use of the color filter, to require a smaller amount of backlight to achieve the same intensity of the transmitted light as that of the color filter type.

FIGS. 29 and 31 are schematic diagrams of background art transmissive liquid crystal display devices using a backlight for emitting light of three colors R, G and B. A liquid crystal display device 300 shown in FIG. 29 is disclosed in Japanese Patent Application Laid-Open No. 2000-28984. In FIG. 29, the reference numeral 301 designates a liquid crystal panel using ferroelectric or antiferroelectric liquid crystal elements capable of high-speed response; 302 designates a backlight having a group of LEDs (Light-Emitting Diodes) for emitting light of each of the colors R, G and B; 305 designates a source driver for driving signal lines of the liquid crystal panel 301; and 306 designates a gate driver for selectively driving scanning lines of the liquid crystal panel 301. Light emitted from the backlight 302 is directed through a light guide plate (not shown) onto the backside of the liquid crystal panel 301. Display data DD for display on the liquid crystal panel 301 is inputted to an image memory 303 from, for example, a personal computer. The image memory 303 temporarily stores therein the inputted display data DD, and then outputs data (referred to hereinafter as pixel data PD) for each pixel in synchronism with a synchronizing signal SYN provided from a control signal generating circuit 304. The pixel data PD is transmitted to a first input terminal of a selector 310 and to an inverted data generating circuit 309.

The control signal generating circuit 304 generates the synchronizing signal SYN to output the synchronizing signal SYN to the gate driver 306, a reference voltage generating circuit 307 and a backlight control circuit 308 including a drive power supply. The gate driver 306 controls the on/off operation of the scanning lines of the liquid crystal panel 301 in synchronism with the synchronizing signal SYN. The reference voltage generating circuit 307 generates a reference voltage VR in synchronism with the synchronizing signal SYN to provide the reference voltage VR to the source driver 305 and the gate driver 306. The backlight control circuit 308 provides a drive voltage synchronous with the synchronizing signal SYN to the backlight 302 to cause the LEDs constituting the backlight 302 to emit light. FIG. 30A is a timing chart showing the lighting timing of the backlight. The backlight 302 emits R light, G light and B light corresponding to an R subframe, a G subframe and a B subframe, respectively, in a time-shared manner during one frame display period (1/60 second). FIG. 30B is a timing chart showing a data write scanning signal and a data erase scanning signal in timed relation to the lighting of the LEDs of the three colors shown in FIG. 30A.

The inverted data generating circuit 309 produces inverted data #PD which is an inverted version of the pixel data PD to output the inverted data #PD to a second input terminal of the selector 310. The selector 310 selects one of the pixel data PD and the inverted data #PD in accordance with a control signal CS transmitted from the control signal generating circuit 304 to output the selected data to the source driver 305. The source driver 305 provides a voltage signal corresponding to the pixel data PD or the inverted data #PD through the signal lines of the liquid crystal panel 301 to the pixel electrodes. When the voltage signal corresponding to the inverted data #PD is provided, an electric field equal in intensity to but opposite in polarity from an electric field applied during data write scanning is applied to the pixel electrodes of the liquid crystal panel 301 during data erase scanning shown in FIG. 30B to erase (or turn off) display of pixels.

One of the features of a display control method for the liquid crystal display device 300 lies in producing a difference in time interval of light emission from the backlight 302 between at least two of the colors R, G and B. Additionally, the time intervals of light emission from the backlight 302 are not constant for the respective colors, and a scanning signal is provided so as to correspond to a light emission sequence in which the light emission time intervals are adjusted depending on the light emission intensities of the LEDs of the respective colors. Thus providing variable control of at least one of the light emission time interval of and the light emission intensity of the LEDs of each color of the backlight 302 allows adjustment of chromaticity of a display color and a wide range of color balance adjustment.

A background art liquid crystal display device 311 shown in FIG. 31 is disclosed in Japanese Patent Application Laid-Open No. 2000-147454. The liquid crystal display device 311 is substantially similar in functionality to the liquid crystal display device 300 shown in FIG. 29 except for the structure of the backlight 302 and the light emission control method for the backlight 302. Elements in FIG. 31 designated by the same reference numerals and characters as those shown in FIG. 29 are substantially identical in functionality with those of the liquid crystal display device 300. The liquid crystal display device 311 is intended to suppress the unevenness of brightness within a display region of the liquid crystal panel 301, and features optically dividing a light emission region of the backlight 302 into a plurality of blocks $\mathbf{302}_1$, $\mathbf{302}_2$ and $\mathbf{302}_3$ having different light emission intensities.

Unfortunately, the background art liquid crystal display devices 300 and 311 are incapable of controlling a change in display order of subframes for the input display data DD and of controlling the "on" period and display brightness of the LEDs for each color. When a liquid crystal panel having a relatively low response speed exceeding about 100 microseconds is used, it is important to control the lighting of the backlight at the time of a change between subframes and to control the timing of writing of image data into the liquid crystal panel. However, the liquid crystal display devices 300 and 311 are based on the premise that the devices 300 and 311 employ the ferroelectric or antiferroelectric liquid crystal material capable of high-speed response. Therefore, the above-mentioned background art applications do not disclose the control of the lighting of the backlight and the control of timing of data writing.

SUMMARY OF THE INVENTION

It is an object of the present invention to provide a liquid crystal display device capable of controlling the writing timing of image data into a liquid crystal panel and the lighting timing of a backlight to improve the quality of a display image and a display brightness.

According to the present invention, a liquid crystal display device includes a transmissive liquid crystal display panel devoid of any color filter, an image data processor, a driver circuit, a backlight, a backlight controller, a judging circuit, and a controller. The image data processor converts one frame of an image including a plurality of color components into a plurality of subframes each consisting of a single color component to output the subframes in predetermined order. The driver circuit drives the liquid crystal display panel based on the subframes received from the image data processor. The backlight illuminates a backside of the liquid crystal display panel, and includes a light source for emitting light of a plurality of colors. The backlight controller controls the backlight to turn on to emit light of a color corresponding to a color component of each of the subframes in a time-shared manner in synchronism with the time at which the driver circuit writes each of the subframes into the liquid crystal display panel. The judging circuit calculates difference data between adjacent ones of the subframes which are successive in display order on a pixel-by-pixel basis to judge whether or not there is a subframe-to-subframe difference therebetween on a line-by-line basis, based on the difference data for one line. The controller temporarily shortens a write cycle duration of a clock for defining the timing of writing of image data for a line judged by the judging circuit to be devoid of the subframe-to-subframe difference into the liquid crystal display panel. The driver circuit reduces a pulse width of an address signal to be applied to a scanning line of the liquid crystal display panel in accordance with the write cycle duration.

The liquid crystal display device can judge whether or not the difference between the subframes successive in display order is large on a line-by-line basis, and substantially skip the writing of image data for a line judged to be devoid of the difference. This reduces the display period of the subframes. Additionally, the liquid crystal display device reduces a time lag between the "on" period of the backlight and the display period of the image data to display a high-quality image with improved contrast and hue.

These and other objects, features, aspects and advantages of the present invention will become more apparent from the following detailed description of the present invention when taken in conjunction with the accompanying drawings.

DESCRIPTION OF THE PREFERRED EMBODIMENTS

Various preferred embodiments according to the present invention will now be described.

First Preferred Embodiment

Figure 1:
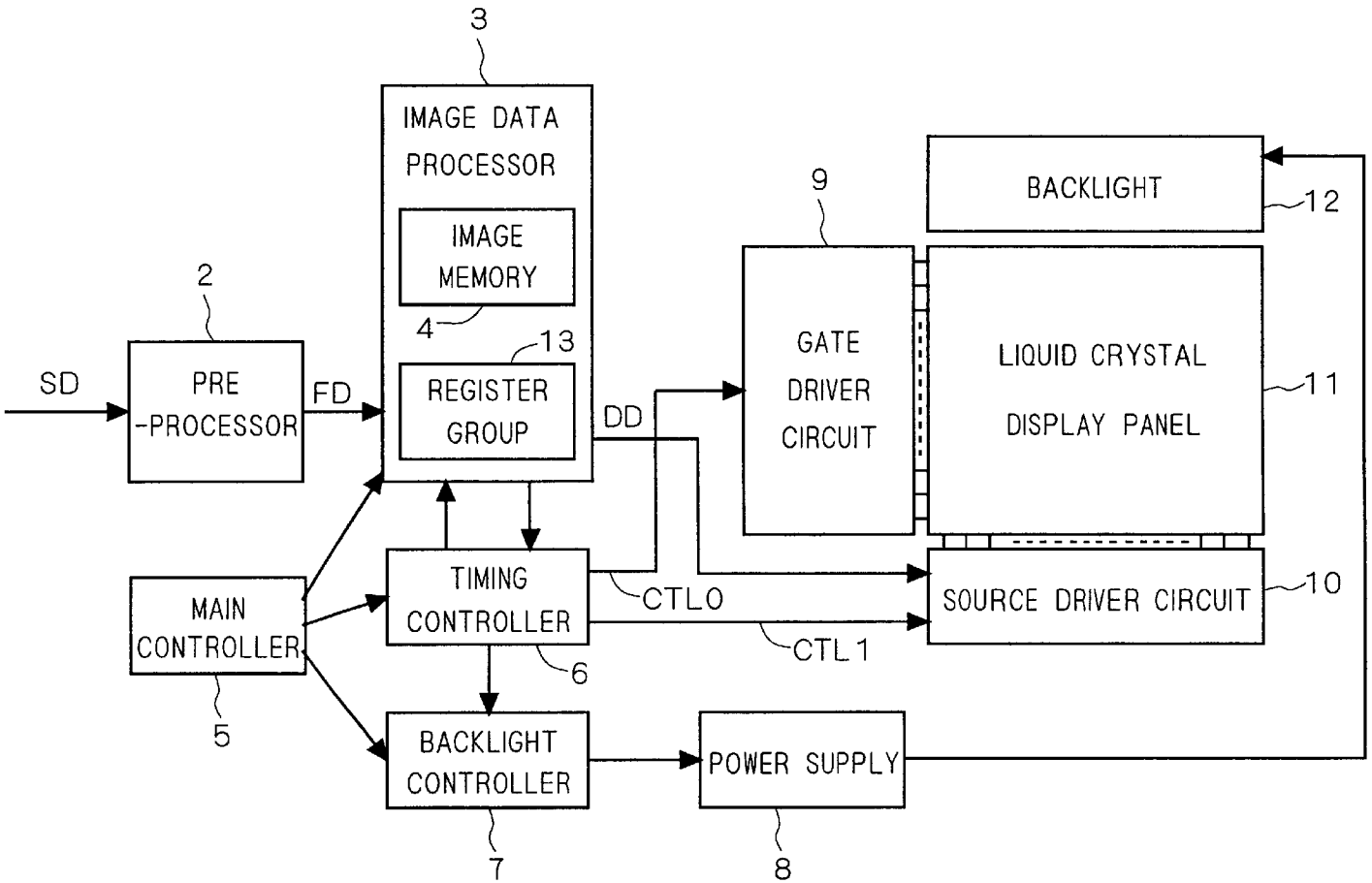
FIG. 1 is a schematic diagram of a liquid crystal display device according to a first preferred embodiment of the present invention.

FIG. 1 is a schematic diagram of a liquid crystal display device 1 according to a first preferred embodiment of the present invention. In FIG. 1, the reference numeral 11 designates a transmissive liquid crystal display panel having no color filter; 9 designates a gate driver circuit for driving the liquid crystal display panel 11; 10 designates a source driver circuit; 12 designates a backlight for illuminating the backside of the liquid crystal display panel 11; and 8 designates a drive power supply for providing a pulse current to the backlight 12.

A backlight controller 7 has the function of determining the lighting timing of the backlight 12 in accordance with an instruction from a main controller 5 to control the drive power supply 8 according to the lighting timing. The backlight 12 comprises LEDs for each color of R, G and B, and is disposed under one end of the liquid crystal display panel 11. LED light emitted from the backlight 12 propagates and scatters while being totally reflected through a light guide plate (not shown) such as an acrylic sheet disposed entirely under the backside of the liquid crystal display panel 11 to illuminate the backside of the liquid crystal display panel 11 substantially uniformly.

Figure 2:
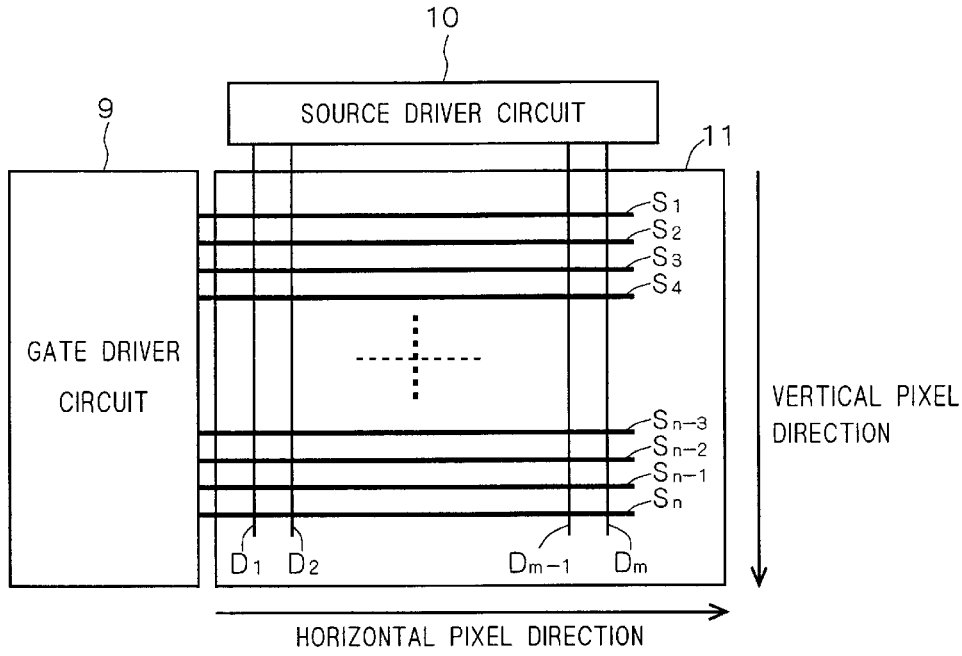
FIG. 2 is a schematic diagram of a liquid crystal display panel of the liquid crystal display device according to the first preferred embodiment.
Figure 27:
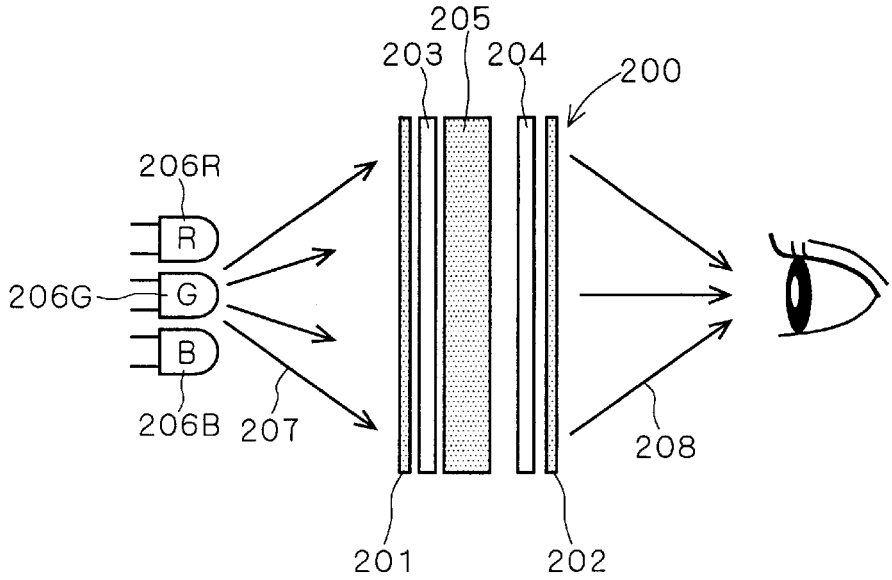
FIG. 27 is a schematic view showing a sectional structure of another background art liquid crystal panel for use in the transmissive liquid crystal display device.
Figure 28:
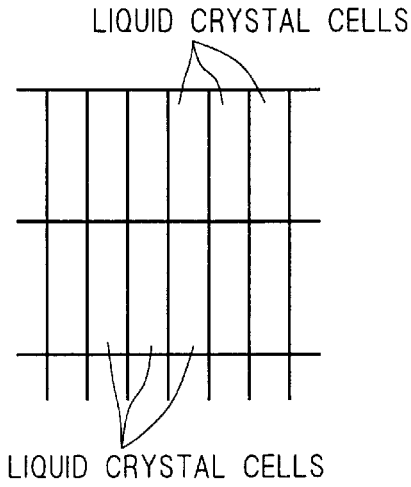
FIG. 28 is a schematic view showing an example of the arrangement of liquid crystal cells.
Figure 29:
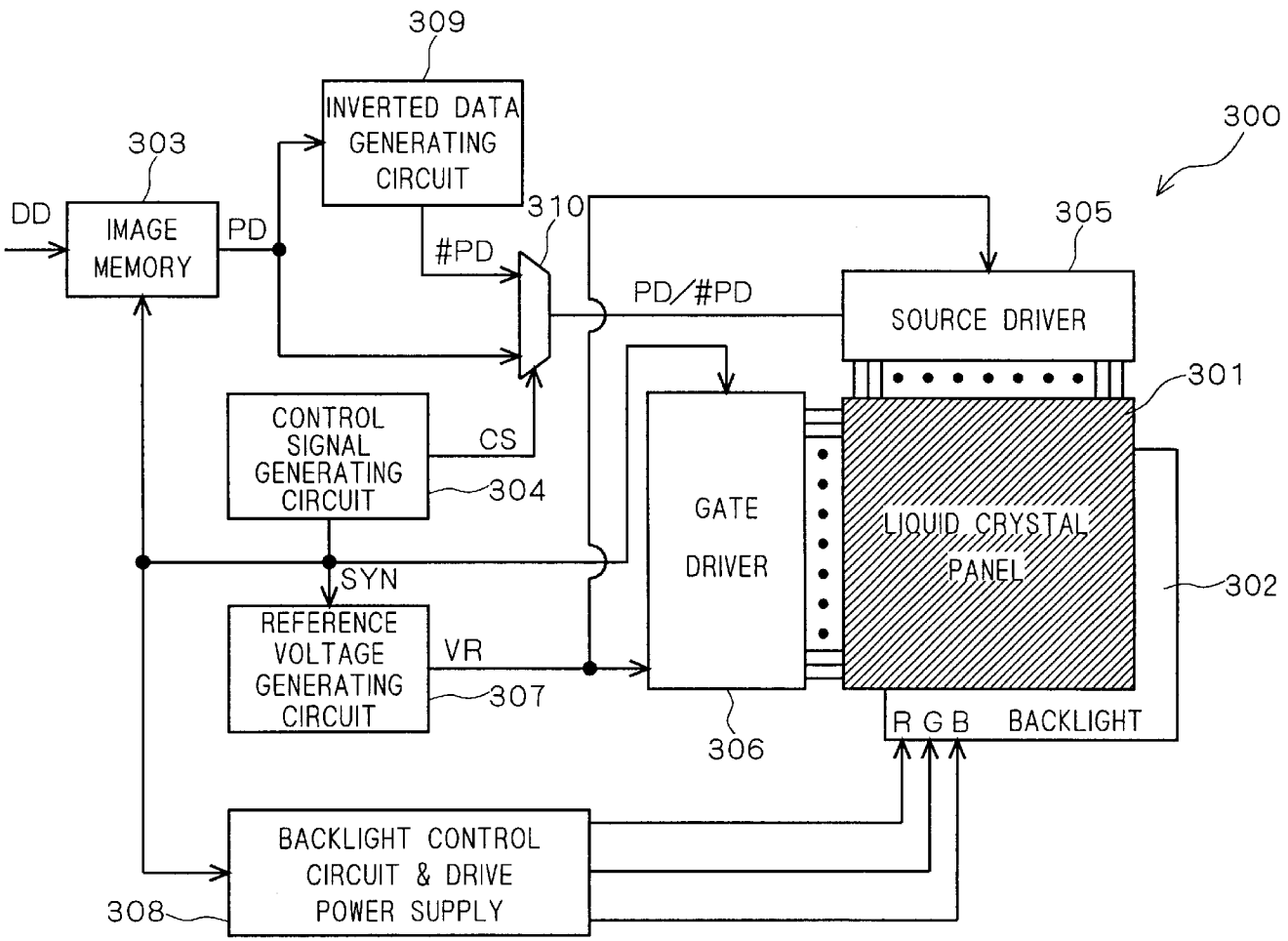
FIG. 29 is a schematic diagram of a liquid crystal display device disclosed in Japanese Patent Application Laid-Open No. 2000-28984.
Figure 30A:
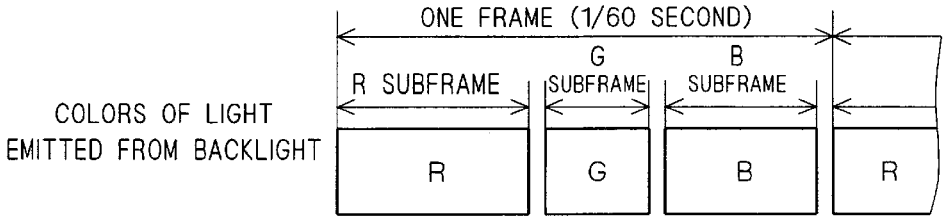
FIGS. 30A and 30B are timing charts for illustrating a display control method for the liquid crystal display device shown in FIG. 29.
Figure 30B:
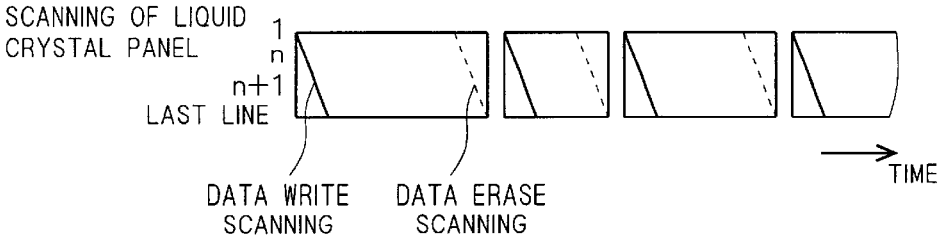

The liquid crystal display panel 11, as shown in FIG. 27, comprises the polarizing filters 201, 202, the array substrate 203 and the glass substrate 204 which are disposed in opposed relation to each other between the polarizing filters 201 and 202, and the liquid crystal layer 205 sealed in a space between the substrates 203 and 204. An alignment layer (not shown) for aligning or orienting liquid crystal molecules in the liquid crystal layer 205 and transparent electrodes (not shown) in the form of an ITO (Indium Tin Oxide) film or the like are formed between the liquid crystal layer 205 and each of the substrates 203, 204. As shown in FIG. 2, n scanning lines (gate electrode lines) $S_1$, $S_2$, . . . , $S_{n-2}$, $S_{n-1}$ and $S_n$ (where n is an integer) extending in a horizontal pixel direction and connected to the gate driver circuit 9, and m signal lines (data electrode lines) $D_1$, $D_2$, . . . $D_{m-2}$, $D_{m-1}$ and $D_m$ (where m is an integer) extending in a vertical pixel direction and connected to the source driver circuit 10 are formed on the surface of the array substrate 203. The scanning lines $S_1$ to $S_n$ and the signal lines $D_1$ to $D_m$ are disposed to define a matrix, and a TFT (thin film transistor) serving as an active element and a pixel electrode (not shown) are formed near each of the intersections of the scanning lines $S_1$ to $S_n$ and the signal lines $D_1$ to $D_m$. A timing controller 6 provides control clock signals CTL0 and CTL1 to the gate driver circuit 9 and the source driver circuit 10, respectively.

Such a liquid crystal display panel 11 is driven by line sequential scanning. Specifically, the gate driver circuit 9 sequentially selects the scanning lines $S_1$ to $S_n$ during one frame display period. When an address signal (gate pulse) is applied to a given scanning line $S_i$ ($1<i\leqq n$), all TFTs that lie on the scanning line $S_i$ are switched on. A data signal provided from the source driver circuit 10 to the signal lines $D_1$ to $D_m$ is provided through the TFTs connected to the scanning line $S_i$ to the corresponding pixel electrodes, whereby data is written.

A pre-processor 2 receives an analog video signal SD from a video signal source such as a personal computer and a work station. The pre-processor 2 performs a gain adjustment, an A/D conversion and the like upon the inputted video signal SD to output digital image data FD which is eight bits for each color R, G and B in parallel to an image data processor 3.

In this preferred embodiment, the video signal SD is an analog signal. In other words, the external video signal source performs a D/A conversion upon image data stored as digital data into the video signal SD and then transmits the video signal SD to the liquid crystal display device 1. On the other hand, there may be cases where the video signal source transmits a digital video signal SD to the liquid crystal display device 1 through a digital interface which employs a low voltage amplitude differential transmission scheme such as a TMDS (Transition Minimized Differential Signaling) scheme and an LVDS(Low Voltage Differential Signaling) scheme. In such cases, the pre-processor 2 has a receiving circuit for the digital interface, and converts the inputted digital video signal SD into the digital image data FD which is at least eight bits to output the digital image data FD to the image data processor 3. When the digital interface of this type is used, the video signal source need not perform the D/A conversion upon the image signal stored as the digital data into the analog signal. This avoids the degradation of the image signal resulting from the D/A conversion and suppresses the generation of EMI (Electro Magnetic Interface) noises, to provide the advantage of improving an image quality.

The image data processor 3 is an integrated circuit having the function of outputting to the source driver circuit 10 pixel data stored in an image memory 4 in the form of display data DD for each subframe in the following order: R, B and G. The image data processor 3 comprises the image memory 4 having a storage capacity of at least one frame of the image data FD. The image memory 4 temporarily stores therein the image data FD inputted from the pre-processor 2 on a frame-by-frame basis. It should be noted that one frame is comprised of an R subframe consisting of only pixel data for an R component, a B subframe consisting of only pixel data for a B component, and a G subframe consisting of only pixel data for a G component.

Figure 3:
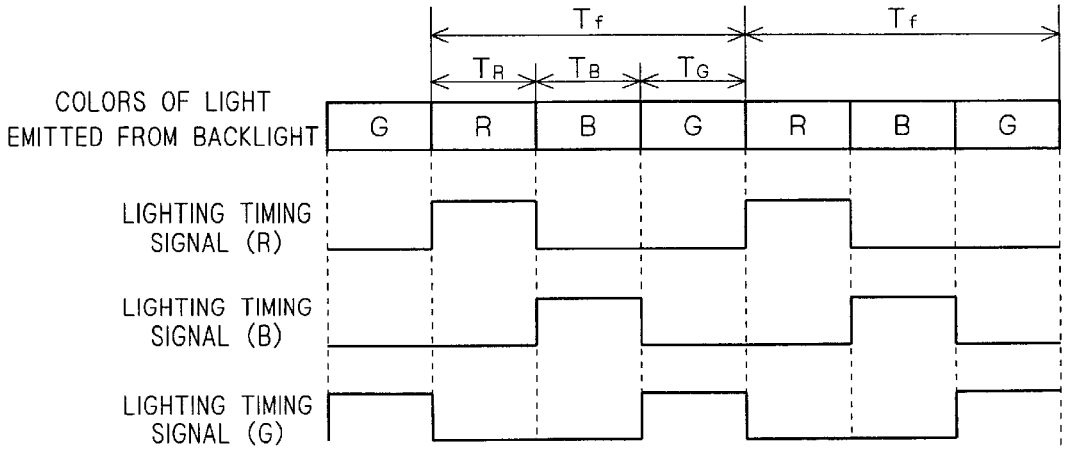
FIG. 3 is a timing chart showing the lighting timing of a backlight.

The source driver circuit 10 sequentially latches and acquires the display data DD inputted from the image data processor 3 in predetermined timed relation. Next, the display data DD is converted by an D/A converter into an analog signal (a gray-scale voltage) which in turn is subjected to an impedance conversion by an output circuit and is then provided to the signal lines $D_1$ to $D_m$ of the liquid crystal display panel 11. The backlight 12 is timing-controlled to turn on the R, B and G LEDs in a time-shared manner in timed relation to the supply of the display data DD to the signal lines $D_1$ to $D_m$. FIG. 3 shows an example of a timing chart when the R, B and G LEDs are turned on. This timing chart shows lighting timing signals for the R, B and G LEDs and colors (R, B and G) of light emitted from the backlight 12. In FIG. 3, Tf indicates a frame display period, and $T_R$, $T_B$ and $T_G$ indicate "on" periods of the R, B and G LEDs, respectively. One color image (frame) is time-divided into three sequential subframes for R, B and G. As illustrated in FIG. 3, the display data DD for the R subframe, B subframe and G subframe are written into the liquid crystal display panel 11 in timed relation to the "on" periods $T_R$, $T_B$ and $T_G$ of the R, B and G LEDs, respectively. A method of displaying one frame by high-speed sequential changes between the subframes for display in timed relation to the "on" periods $T_R$, $T_B$ and $T_G$ is known as a field sequential scheme.

Figure 4:
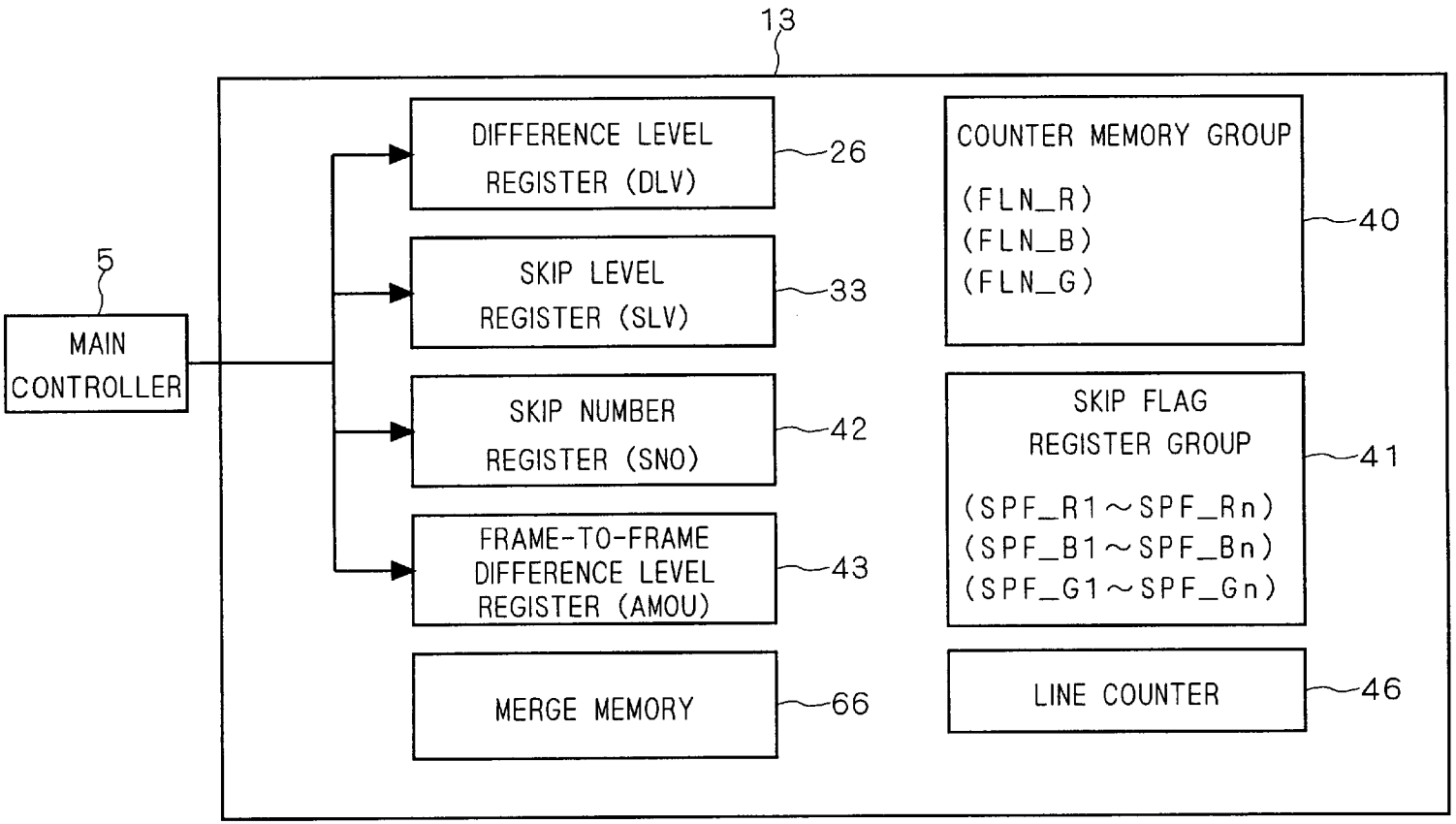
FIG. 4 is a schematic diagram showing a construction of a register group in an image data processor of the liquid crystal display device according to the first preferred embodiment.

The image data processor 3 comprises a register group 13 for holding various parameters to be described below. FIG. 4 is a schematic diagram showing the construction of the register group 13. The register group 13 comprises registers 26, 33, 42, 43 for holding initial values transmitted from the main controller 5 at turn-on of the liquid crystal display device 1, and registers 40, 41, 46, 66 updated whenever necessary in the course of processing.

Figure 5:
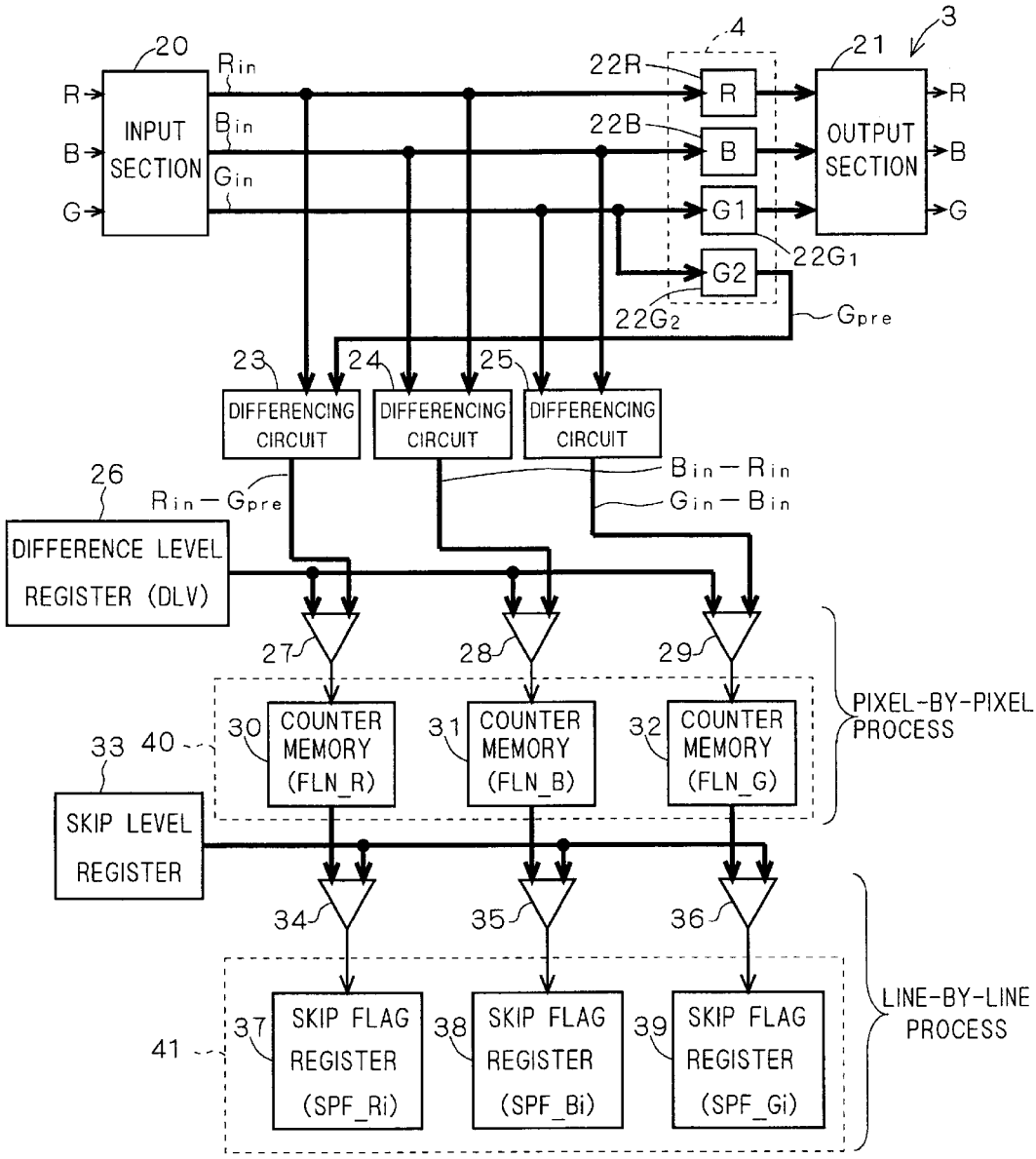
FIG. 5 is a schematic diagram of part of the image data processor of the liquid crystal display device according to the first preferred embodiment.

FIG. 5 is a schematic diagram showing part of the image data processor 3. The image data processor 3 comprises an input section 20 for receiving image data FD for R, B, G in parallel on a pixel-by-pixel basis; the image memory 4 for temporarily storing therein the inputted pixel data on a frame-by-frame basis; an output section 21 for serially outputting the pixel data read from the image memory 4; differencing circuits 23, 24, 25; and comparator circuits 27, 28, 29, 34, 35, 36. The register group 13 in the image data processor 3 includes the counter memory group 40, the skip flag register group 41, the difference level register 26, and the skip level register 33.

The image memory 4 comprises a frame memory 22R for storing the R subframe, a frame memory 22B for storing the B subframe, and frame memories 22$G_1$, 22$G_2$ for storing the G subframe. Each of the frame memories 22R, 22B, 22$G_1$ and 22$G_2$ is a 2-port memory having an arbiter circuit for controlling the writing and reading of data in a time-shared manner. The arbiter circuit can asynchronously perform the writing of the image data FD into each of the frame memories 22R, 22B, 22$G_1$ and 22$G_2$ and the reading of the subframe therefrom.

In FIG. 5, the reference characters $R_{in}$, $B_{in}$ and $G_{in}$ denote pixel data for the R, B and G components, respectively, inputted through the input section 20, and $G_{pre}$ denotes pixel data for the G component for the immediately preceding frame. The pixel data $R_{in}$, $B_{in}$, $G_{in}$ are inputted in parallel, and sequentially written into the frame memories 22R, 22B, 22$G_1$, respectively. The pixel data $G_{in}$ is also written into the frame memory (auxiliary memory) 22$G_2$ in timed relation to the writing of the pixel data $G_{in}$ into the frame memory 22$G_1$. The read cycle of the pixel data $G_{pre}$ stored in the auxiliary memory 22$G_2$ coincides with the write cycle of the pixel data $G_{in}$, and the read address of the pixel data $G_{pre}$ coincides with the write address of the pixel data $G_{in}$, although timing control is performed so that the reading of the pixel data $G_{pre}$ for the immediately preceding frame precedes the writing of the pixel data $G_{in}$ into the frame memory 22$G_2$.

Figure 6:
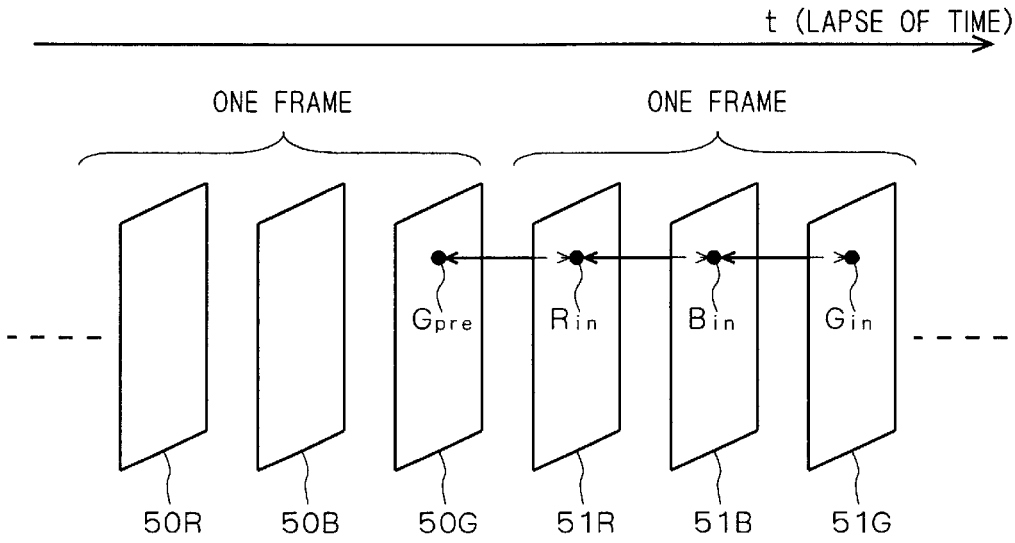
FIG. 6 illustrates a method of calculating difference data between subframes successive in display order.

The differencing circuits 23, 24, 25 calculate difference data between subframes successive in display order on a pixel-by-pixel basis. As shown in FIG. 6, the display order of the display data DD is as follows: an R subframe 50R, a B subframe 50B, a G subframe 50G, an R subframe 51R, a B subframe 51B, a G subframe 51G, . . . . On the other hand, the order in which the image data FD is inputted to the image data processor 3 on a pixel-by-pixel basis is as follows: R, B, G, R, B, G, . . . although the pixel data for R, B, G are inputted in parallel at the same time. The differencing circuit 23 calculates difference data ($R_{in}$–$G_{pre}$) about the pixel data $R_{in}$ and $G_{pre}$ between the R subframe and the G subframe included in the immediately preceding frame which are successive in display order to output the difference data ($R_{in}$–$G_{pre}$) to the comparator circuit 27. The differencing circuit 24 calculates difference data ($B_{in}$–$R_{in}$) about the pixel data $B_{in}$ and $R_{in}$ between the B subframe and the R subframe which are successive in display order to output the difference data ($B_{in}$–$R_{in}$) to the comparator circuit 28. The differencing circuit 25 calculates difference data ($G_{in}$–$B_{in}$) about the pixel data $G_{in}$ and $B_{in}$ between the G subframe and the B subframe which are successive in display order to output the difference data ($G_{in}$–$B_{in}$) to the comparator circuit 29.

The comparator circuits 27, 28 and 29 receive a difference level DLV from the difference level register 26, and compare the values of the difference data ($R_{in}$–$G_{pre}$), ($B_{in}$–$R_{in}$) and ($G_{in}$–$B_{in}$) inputted from the differencing circuits 23, 24 and 25, respectively, with the difference level DLV. If the value of a corresponding one of the difference data is greater than the difference level DLV, the comparator circuits 27, 28 and 29 judge that a difference in pixel data between the subframes successive in display order is large, and output an H level (high level) signal to counter memories 30, 31 and 32, respectively.

Next, the counter memories 30, 31 and 32 execute a counting operation (increment) each time the H level signal is inputted from the comparator circuits 27, 28 and 29 to hold counts FLN_R, FLN_B and FLN_G, respectively. Thus, the greater the difference in pixel data between the subframes, the greater the counts FLN_R, FLN_B and FLN_G. After the counting operation for one line, the counter memories 30, 31 and 32 output the counts FLN_R, FLN_B and FLN_G held therein to the comparator circuits 34, 35 and 36, respectively, and then reset the counts FLN_R, FLN_B and FLN_G to their initial value for counting operation for the next line.

The comparator circuits 34, 35 and 36 receive a skip level SLV from the skip level register 33, and compare the counts FLN_R, FLN_B and FLN_G, respectively, with the skip level SLV. If a corresponding one of the counts is less than the skip level SLV, the comparator circuits 34, 35 and 36 judge that a difference in the current line between the subframes successive in display order is small, and output an H level signal to the skip flag registers 37, 38 and 39, respectively. On the other hand, if a corresponding one of the counts is greater than or equal to the skip level SLV, the comparator circuit 34, 35 and 36 judge that the difference in the current line between the subframes successive in display order is large, and output an L level (low level) signal to the skip flag registers 37, 38 and 39, respectively.

Figure 7:
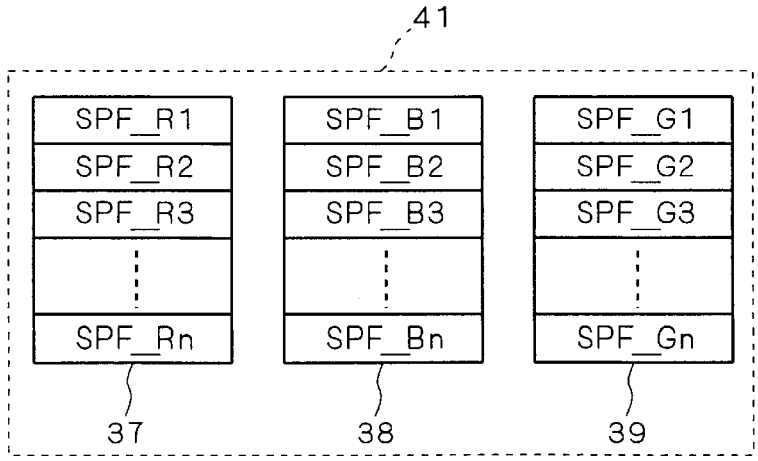
FIG. 7 schematically shows a data structure of skip flag registers.

Upon receipt of the H level signal from the comparator circuit 34, the skip flag register 37 holds therein a skip flag SPF_Ri (where i is a horizontal line number, and $0<i\leqq n$) having a value "1" for the current line. On the other hand, upon receipt of the L level signal from the comparator circuit 34, the skip flag register 37 holds therein the skip flag SPF_Ri having a value "0" for the current line. Likewise, the skip flag registers 38 and 39 hold therein skip flags SPF_Bi and SPF_Gi, respectively, having a value "0" or "1" for the current line, depending on the signal level inputted from the comparator circuits 35 and 36. FIG. 7 schematically shows a data structure of the skip flag registers 37, 38 and 39. The skip flag registers 37, 38 and 39 have storage areas for holding skip flags SPF_R1 to SPF_Rn, SPF_B1 to SPF_Bn, and SPF_G1 to SPF_Gn corresponding to the number of horizontal lines in the R, B and G subframes, respectively.

A display control operation of the liquid crystal display device 1 having the image data processor 3 as discussed above will be described.

As stated above, when the image data processor 3 receives one frame of the image data FD, the one frame of the image data FD is stored in the image memory 4 of the image data processor 3. At the same time, the skip flags SPF_R1 to SPF_Rn, SPF_B1 to SPF_Bn, and SPF_G1 to SPF_Gn are stored in the skip flag register group 41.

Figure 8:
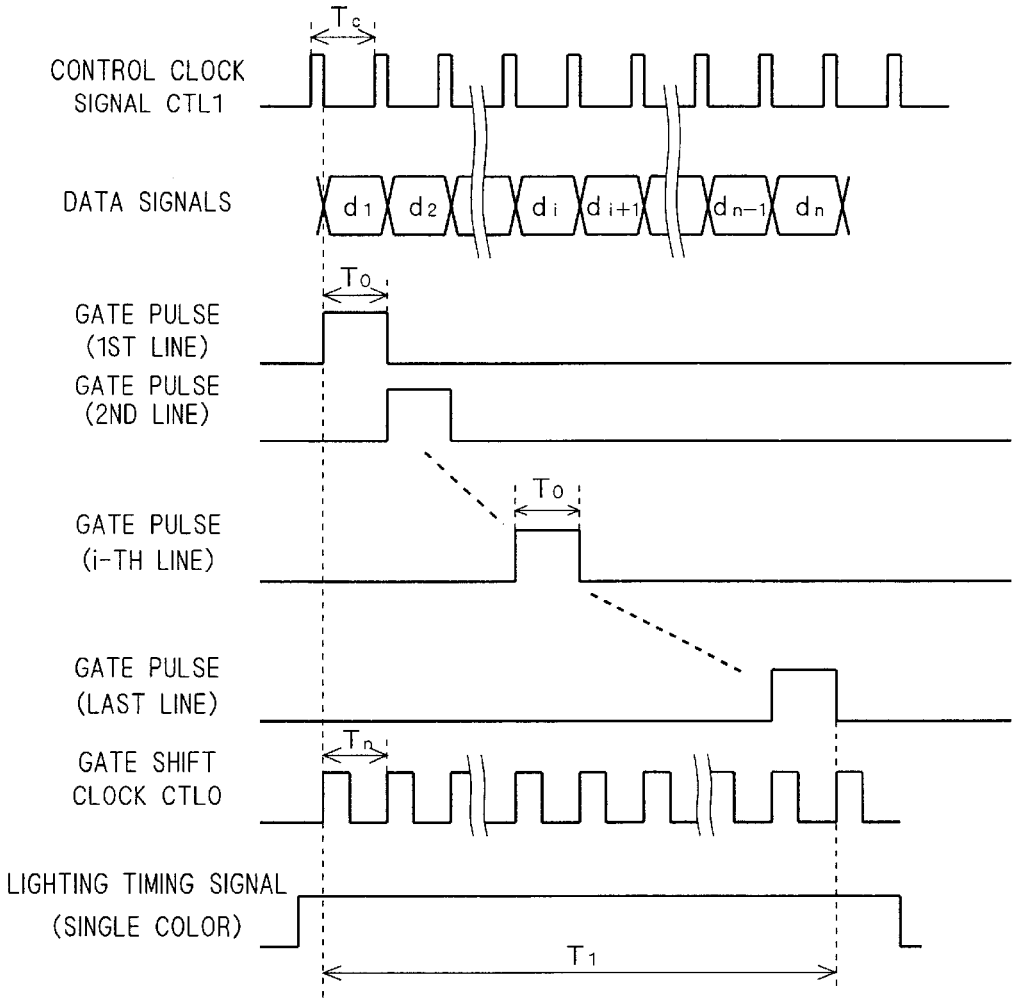
FIGS. 8 and 9 are timing charts showing the waveforms of various signals for driving the liquid crystal display panel of the liquid crystal display device according to the first preferred embodiment.

Operation in the case where the skip flags SPF_R1 to SPF_Rn, SPF_B1 to SPF_Bn, and SPF_G1 to SPF_Gn are all "0" or the difference in a line between subframes successive in display order is large is as follows: The display data DD read on a subframe-by-subframe basis from the image memory 4 is provided to the source driver circuit 10 to which the control clock signal (write clock signal) CTL1 shown in FIG. 8 is provided from the timing controller 6. The source driver circuit 10 stores the inputted pixel data in a built-in shift register (not shown) and sequentially shifts the pixel data in timed relation to the control clock signal CTL1. After the pixel data for one horizontal line is shifted, the shift register outputs the shifted pixel data to a latch circuit (not shown). The latch circuit holds therein the pixel data for the one horizontal line. The pixel data held in the latch circuit is converted by the D/A converter into the analog signal (gray-scale voltage) which in turn is subjected to the impedance conversion by the output circuit and is then provided as data signals $d_1, d_2, \ldots, d_n$ shown in FIG. 8 to the signal lines $D_1$ to $D_m$.

The control clock signal (gate shift clock) CTL0 shown in FIG. 8 is provided from the timing controller 6 to the gate driver circuit 9. In timed relation to the gate shift clock CTL0, the gate driver circuit 9 generates gate pulses having a pulse width required to store electric charge in a pixel electrode, and provides the gate pulses to the scanning lines $S_1$ to $S_n$, respectively. The source driver circuit 10 provides the data signals $d_1$ to $d_n$ to the signal lines $D_1$ to $D_m$ in timed relation to the gate pulses, whereby the display data DD is written into the liquid crystal display panel 11. Writing the display data DD means storing electric charge in liquid crystal cells, and the data written by the previous scanning is held until new data is written by the current scanning.

Operation in the case where any one of the skip flags SPF_R1 to SPF_Rn, SPF_B1 to SPF_Bn, and SPF_G1 to SPF_Gn is "1" is described below. For purposes of illustration, it is assumed that the skip flag corresponding to the i-th horizontal line of an image is "1." As illustrated in the timing chart of FIG. 9, the timing controller 6 acquires a skip flag SPF corresponding to the i-th horizontal line from one of the skip flag registers 37, 38 and 39 where the skip flag SPF denotes one of the skip flags SPF_R1 to SPF_Rn, SPF_B1 to SPF_Bn, and SPF_G1 to SPF_Gn. If the acquired skip flag SPF is "1," the timing controller 6 temporarily makes the cycle duration Ts of the i-th pulse of the gate shift clock CTL0 shorter than a normal cycle duration Tn. This makes the pulse width Tg of the gate pulse applied to the scanning line $S_i$ corresponding to the i-th line shorter than a normal pulse width To.

Also, the timing controller 6 temporarily makes the cycle duration (write cycle duration) Ta of the i-th pulse of the control clock signal CTL1 shorter than a normal cycle duration Tc, based on the skip flag SPF having "1." This shortens the length of time for which a data signal $d_i$ is supplied to an active element at each of the intersections of the scanning line $S_i$ and the signal lines $D_1$ to $D_m$. The timing control is performed so that the normal cycle duration Tc of pulses of the control clock signal CTL1 is equal to the normal cycle duration Tn of pulses of the gate shift clock CTL0 and that the cycle duration Ta of the i-th pulse of the control clock signal CTL1 is equal to the cycle duration Ts of the i-th pulse of the gate shift clock CTL0. Thus, delay time $T_2$ required for scanning from the first scanning line $S_1$ to the last scanning line $S_n$ is shorter than delay time $T_1$ shown in FIG. 8. This shortens the image write time for the current subframe.

As described hereinabove, the liquid crystal display device 1 according to the first preferred embodiment can judge the presence or absence of the difference between subframes successive in display order on a line-by-line basis, and substantially skip the writing of image data on a line judged to be devoid of the difference. This reduces the display period of each subframe. Additionally, the reduction in time lag between the "on" period of the backlight 12 and the display period of the image allows display of a high-quality image with improved contrast and hue.

First Modification of First Preferred Embodiment

Figure 9:
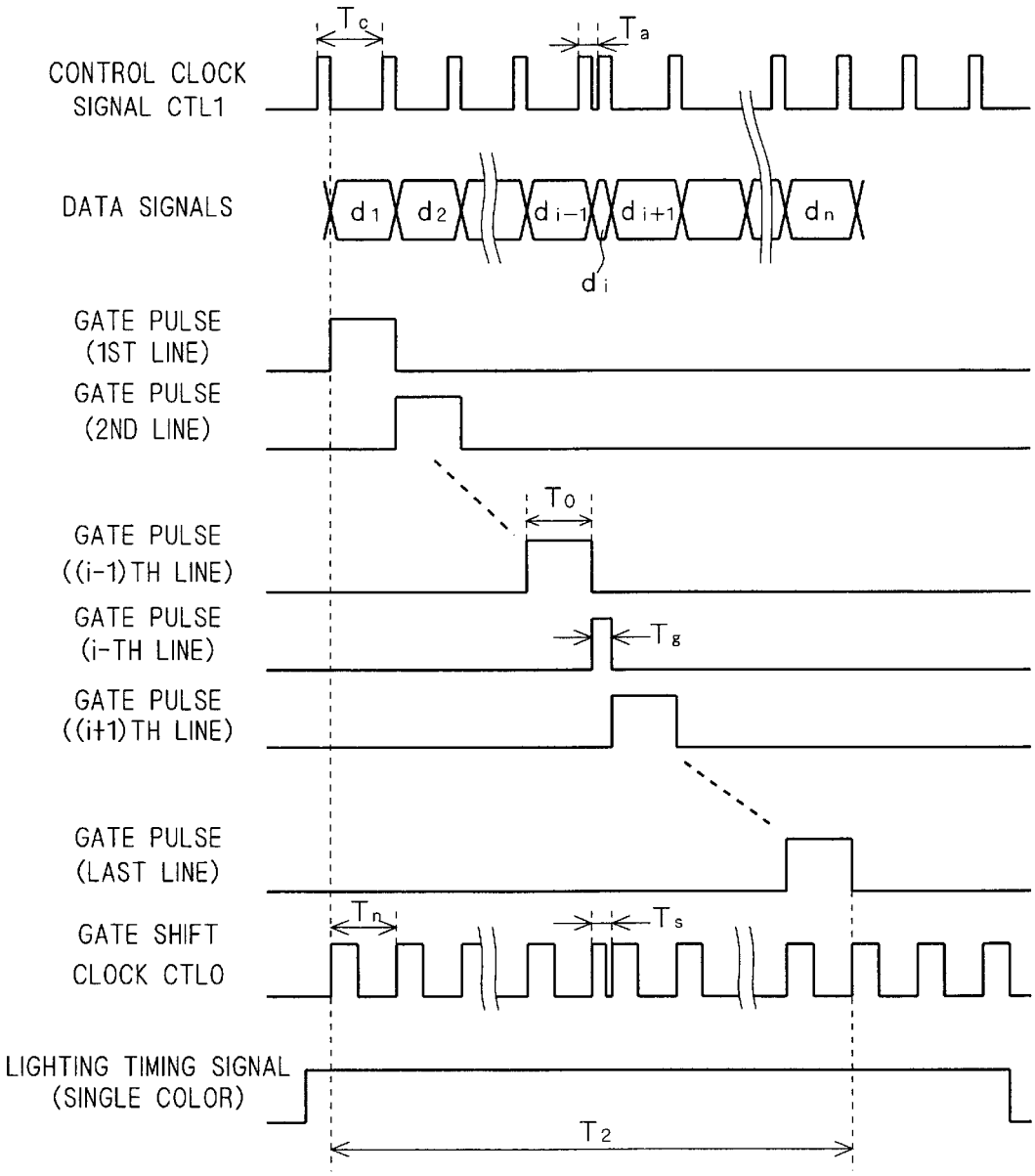

As illustrated in FIG. 9, the pulse width Tg of the gate pulse corresponding to the line for which the skip flag SPF is "1" is practically controlled to fall within a predetermined range. The pulse width Tg which is too small might lower the contrast of the image because electric charge stored in the liquid crystal cells on the line is discharged. In particular, successively skipping the writing into the same line increases the amount of discharge of the electric charge, which makes the lowering of contrast prone to occur. It is therefore desirable that the pulse width Tg is set to a duration long enough to provide the same amount of electric charge as discharged to the liquid crystal cells. The timing controller 6 generates the control clock signal CTL1 in accordance with the effective duration of the gate pulse having such a pulse width Tg, and the source driver circuit 10 supplies the data signal $d_i$ to the signal lines $D_1$ to $D_m$ in accordance with the cycle duration Ta of the i-th pulse of the control clock signal CTL1. This reliably suppresses the lowering of contrast to display a high-quality image.

Second Modification of First Preferred Embodiment

Figure 10:
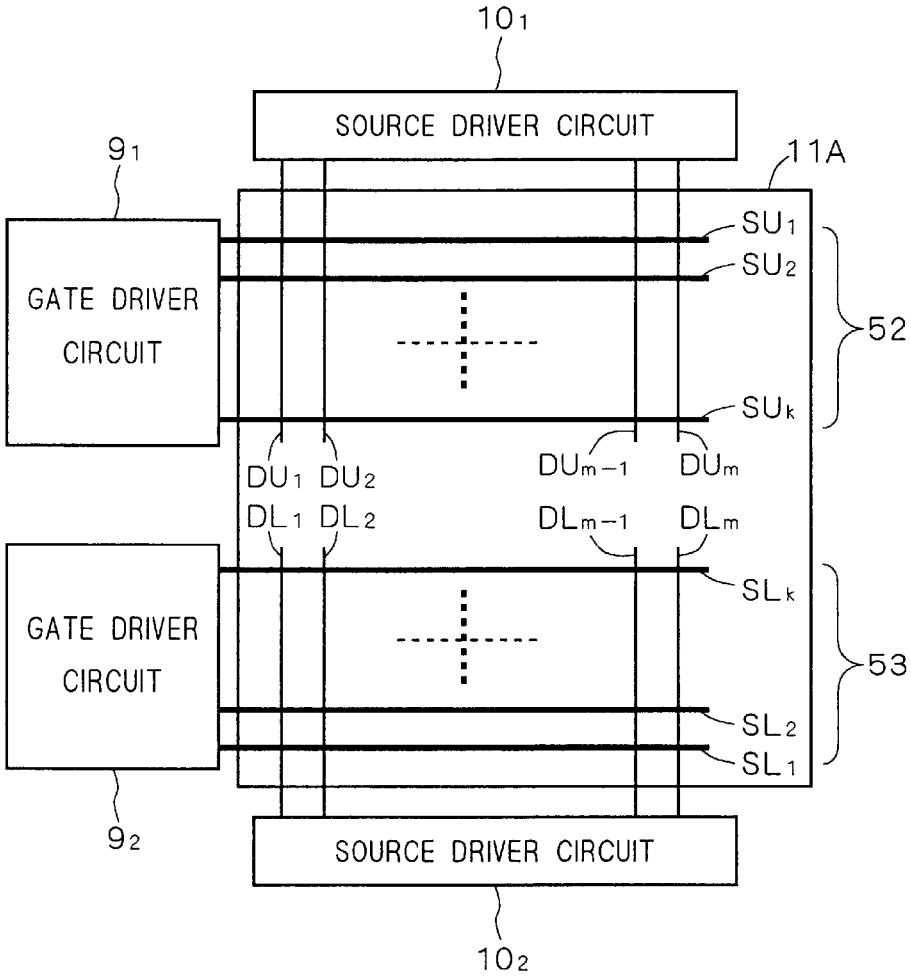
FIG. 10 is a schematic diagram of a modification of the liquid crystal display panel of the liquid crystal display device according to the first preferred embodiment.

In the light of the speedup of writing of an image and the enhancement of resolution, it is preferable to use a liquid crystal display panel 11A shown in FIG. 10 in place of the liquid crystal display panel 11 shown in FIG. 2. The liquid crystal display panel 11A has an upper structure 52 and a lower structure 53 which are driven independently of each other. The upper structure 52 has scanning lines $SU_1$, $SU_2$, . . . , $SU_k$ (where k is an integer) connected to a first gate driver circuit $\mathbf{9}_1$, and signal lines $DU_1$, $DU_2$, . . . , $DU_m$ connected to a first source driver circuit $\mathbf{10}_1$. The lower structure 53 has scanning lines $SL_1$, $SL_2$, . . . , $SL_k$ connected to a second gate driver circuit $\mathbf{9}_2$, and signal lines $DL_1$, $DL_2$, . . . , $DL_m$ connected to a second source driver circuit $\mathbf{10}_2$. The liquid crystal display panel 11A is similar in construction to the liquid crystal display panel 11 shown in FIG. 2 except that the scanning and signal lines in the upper structure 52 and those in the lower structure 53 are provided separately.

Data signals supplied from the source driver circuits $\mathbf{10}_1$ and $\mathbf{10}_2$ are written in parallel separately into the upper and lower structures 52 and 53. Therefore, the display data DD is displayed at high speeds, and the display control method according to the first preferred embodiment is easily applicable to a high-resolution liquid crystal display panel having a relatively large number of pixels.

Second Preferred Embodiment

Figure 11:
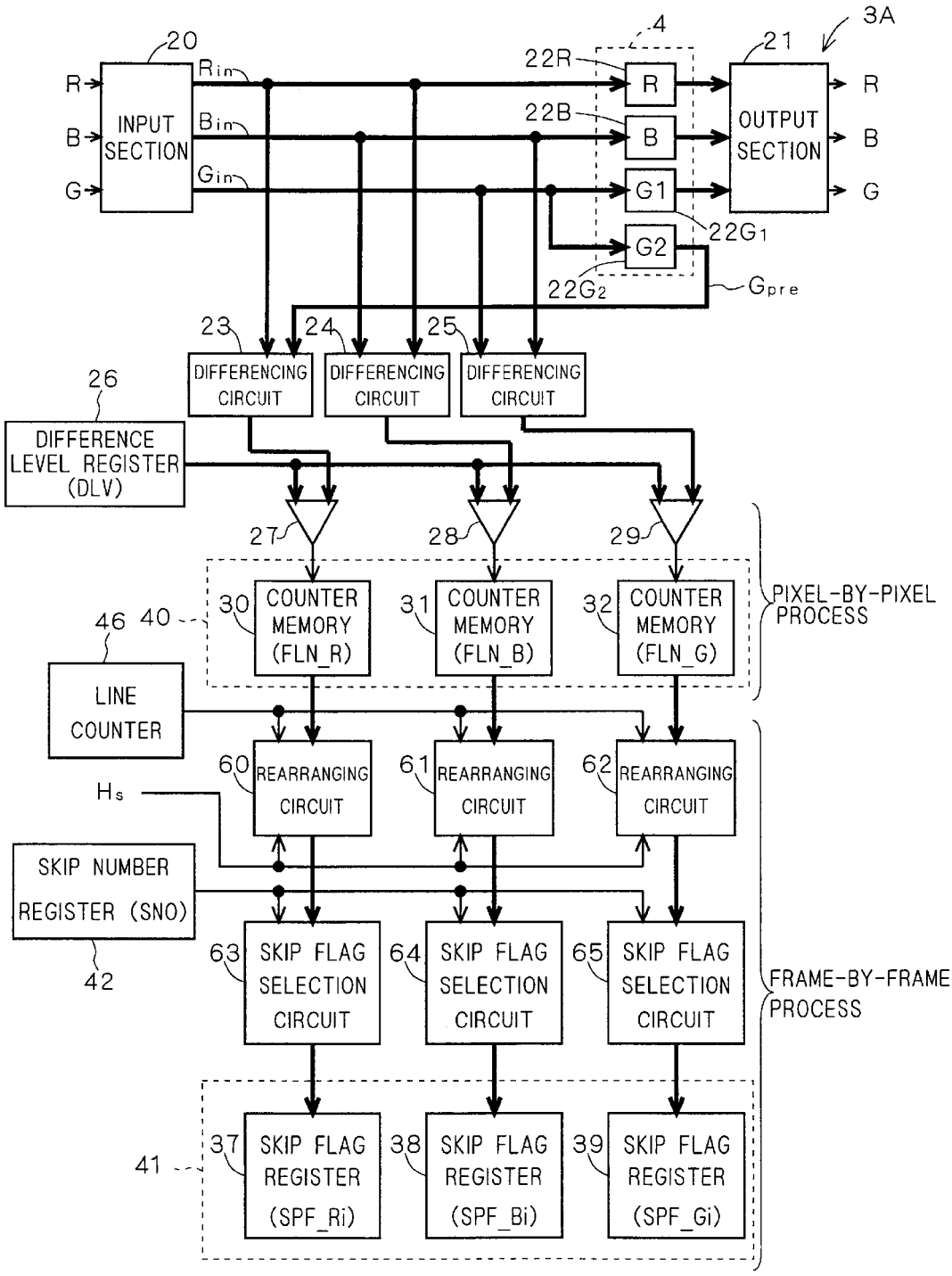
FIG. 11 is a schematic diagram of part of the image data processor of the liquid crystal display device according to a second preferred embodiment of the present invention.

The liquid crystal display device according to a second preferred embodiment of the present invention will be described. FIG. 11 is a schematic diagram of part of an image data processor 3A. The liquid crystal display device according to the second preferred embodiment is substantially similar in construction to the liquid crystal display device 1 according to the first preferred embodiment except that the image data processor 3A is used in place of the image data processor 3 of the first preferred embodiment. Elements of FIG. 11 designated by the same reference characters as in FIG. 5 are substantially similar in functionality to those of FIG. 5 and are not particularly described.

The first preferred embodiment is adapted to skip the writing of image data only on the line for which the counts FLN_R, FLN_B and FLN_G indicating the difference between subframes successive in display order are less than the skip level SLV. In the second preferred embodiment, on the other hand, the number of lines (referred to hereinafter as a skip number SNO) for which the writing of image data is substantially skipped is previously established for each subframe. The skip number SNO is transmitted from the main controller 5 to the skip number register 42 shown in FIG. 4 and stored therein. The lines for which the writing of image data is substantially skipped are specified in ascending order of the counts FLN_R, FLN_B and FLN_G so that the number of lines equals the skip number SNO. This speeds up the writing of image data at a constant rate.

Like the image data processor 3 according to the first preferred embodiment, the image data processor 3A shown in FIG. 11 comprises the image memory 4, the differencing circuits 23 to 25, the difference level register 26, the comparator circuits 27 to 29, and the counter memory group 40. The counter memories 30, 31 and 32 in the counter memory group 40 perform the counting operation for each line, and then output the counts FLN_R, FLN_B and FLN_G to rearranging circuits 60, 61 and 62, respectively.

Figure 12:
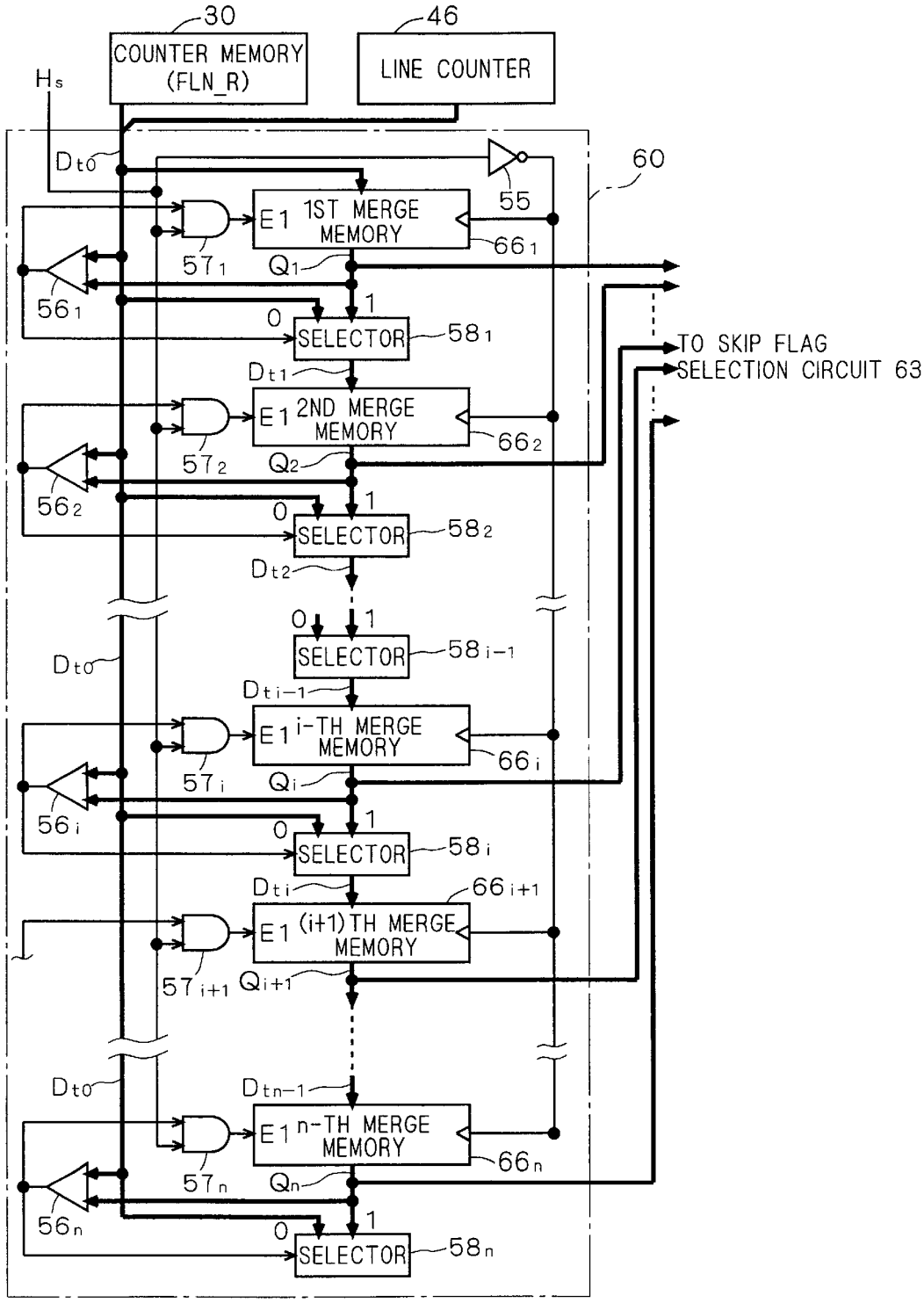
FIG. 12 is a schematic circuit diagram of a rearranging circuit constituting the image data processor shown in FIG. 11.
Figure 13:
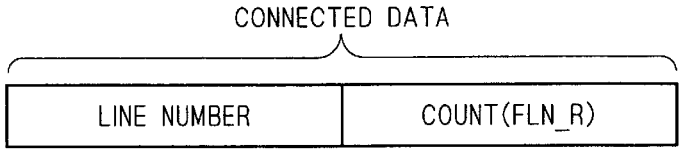
FIG. 13 schematically shows a data structure stored in a merge memory in the rearranging circuit shown in FIG. 12.
Figure 14:
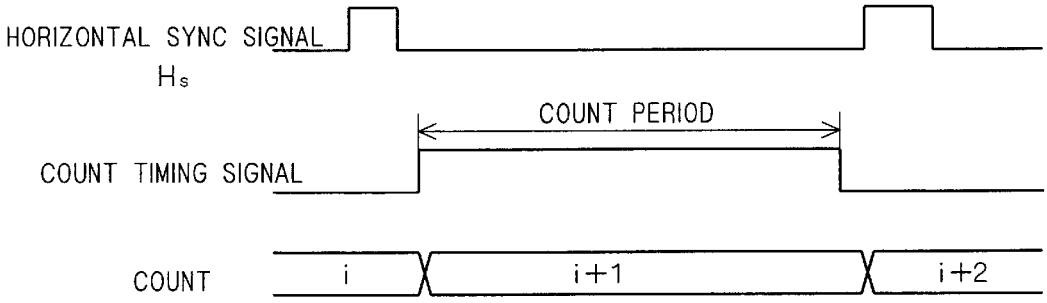
FIG. 14 is a timing chart showing a relationship between a timing signal and a count of a counter memory.

The rearranging circuits 60, 61 and 62 have the function of rearranging the counts FLN_R, FLN_B and FLN_G for each subframe in ascending order to hold the rearranged counts therein. FIG. 12 is a schematic circuit diagram of the rearranging circuit 60 for R subframes. The R subframe rearranging circuit 60 comprises first to n-th merge memories $\mathbf{66}_1$ to $\mathbf{66}_n$ equal in number to the scanning lines $S_1$ to $S_n$, and stores a series of connected data $Dt_0$ in ascending order in the merge memories $\mathbf{66}_1$ to $\mathbf{66}_n$ in predetermined timed relation, the connected data $Dt_0$ being comprised of the count FLN_R inputted from the counter memory 30 and a corresponding line number inputted from a line counter 46 which are bit-connected to each other. FIG. 13 schematically shows an internal structure of the connected data $Dt_0$. The connected data $Dt_0$ has the value of the line number stored in its higher-order bits, and the counts FLN_R stored in its lower-order bits. FIG. 14 is a timing chart showing a relationship between a count timing signal of the counter memory 30 and the count FLN_R.

The first merge memory $\mathbf{66}_1$ receives the connected data $Dt_0$. The first to n-th merge memories $\mathbf{66}_1$ to $\mathbf{66}_n$ are connected in cascade through selectors $\mathbf{58}_1$ to $\mathbf{58}_{n-1}$. Specifically, output data $Q_i$ from an i-th merge memory $\mathbf{66}_i$ ($1 \leqq i \leqq n-1$) can be provided through a selector $\mathbf{58}_i$ in the form of input data $Dt_i$ to an (i+1)th merge memory $\mathbf{66}_{i+1}$ provided in the next stage. When a signal level outputted from a comparator circuit $\mathbf{56}_i$ is "H (High)," the selector $\mathbf{58}_i$ selects a "1" terminal to provide the output data $Q_i$ from the i-th merge memory $\mathbf{66}_i$ to the (i+1)th merge memory $\mathbf{66}_{i+1}$ provided in the next stage. The input data $Dt_0$ is transmitted to "0" terminals of all of the selectors $\mathbf{58}_1$ to $\mathbf{58}_n$. When the signal level outputted from the comparator circuit $\mathbf{56}_i$ is "L (Low)," the selector $\mathbf{58}_i$ selects the "0" terminal to provide the input data $Dt_0$ in the form of output data $Dt_i$ to the (i+1)th merge memory $\mathbf{66}_{i+1}$ provided in the next stage.

A horizontal sync signal Hs is applied to the rearranging circuit 60. An inverter 55 inverts the level of the horizontal sync signal Hs to output an inverted signal IHs to clock terminals of the first to n-th merge memories $\mathbf{66}_1$ to $\mathbf{66}_n$. The first to n-th merge memories $\mathbf{66}_1$ to $\mathbf{66}_n$ operate in synchronism with the inverted signal IHs. The horizontal sync signal Hs is also applied to AND gates $\mathbf{57}_1$ to $\mathbf{57}_n$. The AND gates $\mathbf{57}_1$ to $\mathbf{57}_n$ perform the AND operation of the horizontal sync signal Hs and comparison signals provided from comparator circuits $\mathbf{56}_1$ to $\mathbf{56}_n$, respectively, and output an H level signal to enable terminals E1 of the respective merge memories $\mathbf{66}_1$ to $\mathbf{66}_n$ only during a time period during which both input signal levels are "H."

The first to n-th merge memories $\mathbf{66}_1$ to $\mathbf{66}_n$ acquire input data $Dt_0$, $Dt_1$, . . . , $Dt_{n-1}$, respectively, on the rising edge of the pulses of the inverted signal IHs while the signal level at their enable terminals E1 is "H." The acquired data $Dt_0$, $Dt_1$, . . . , $Dt_{n-1}$ are held in the first to n-th merge memories $\mathbf{66}_1$ to $\mathbf{66}_n$ and provided as output data $Q_1$, $Q_2$, . . . , $Q_n$ to the selectors $\mathbf{58}_1$, $\mathbf{58}_2$, . . . , $\mathbf{58}_n$, respectively.

The comparator circuits $\mathbf{56}_1$ to $\mathbf{56}_n$ compare the output data $Q_1$ to $Q_n$ from the merge memories $\mathbf{66}_1$ to $\mathbf{66}_n$, respectively, with the input data $Dt_0$. The comparator circuits $\mathbf{56}_1$ to $\mathbf{56}_n$ output an H level signal during a time period during which the count FLN_R in the lower-order bits of the output data $Q_1$ to $Q_n$ is not less than the count FLN_R in the lower-order bits of the input data $Dt_0$, and output an L level signal during other than the above-mentioned time period.

The operation of the rearranging circuit 60 is discussed below. The data in the lower-order bits held in the first to n-th merge memories $\mathbf{66}_1$ to $\mathbf{66}_n$ is reset to a maximum possible value of the count FLN_R each time the input data $Dt_0$ for each subframe is processed.

The input data $Dt_0$ for the first line inputted first is transmitted to the first merge memory $\mathbf{66}_1$ and the comparator circuits $\mathbf{56}_1$ to $\mathbf{56}_n$. All of the comparator circuits $\mathbf{56}_1$ to $\mathbf{56}_n$ compare the count FLN_R in the lower-order bits of the input data $Dt_0$ with the maximum value in the lower-order bits of the output data $Q_1$ to $Q_n$ from the merge memories $\mathbf{66}_1$ to $\mathbf{66}_n$ to output an H level signal to the AND gates $\mathbf{57}_1$ to $\mathbf{57}_n$ and the selectors $\mathbf{58}_1$ to $\mathbf{58}_n$. Thus, all of the AND gates $\mathbf{57}_1$ to $\mathbf{57}_n$ output an H level signal to all of the enable terminals E1 during a time period during which the horizontal sync signal Hs is "H." Then, when the inverted signal IHs in the form of pulses is inputted from the inverter 55 to a clock terminal, the first merge memory $\mathbf{66}_1$ acquires and holds the input data $Dt_0$ therein. In parallel therewith, all of the selectors $\mathbf{58}_1$ to $\mathbf{58}_n$ select the "1" terminal to provide the output data $Q_1$ to $Q_{n-1}$ from the first to (n−1)th merge memories $\mathbf{66}_1$ to $\mathbf{66}_{n-1}$ to the second to n-th merge memories $\mathbf{66}_2$ to $\mathbf{66}_n$. Thus, the data held in the first to (n−1)th merge memories $\mathbf{66}_1$ to $\mathbf{66}_{n-1}$ are shifted to the second to n-th merge memories $\mathbf{66}_2$ to $\mathbf{66}_n$.

When the comparator circuit $\mathbf{56}_i$ ($1 \leqq i < n$) judges that the count FLN_R in the lower-order bits of the input data $Dt_0$ is greater than the count FLN_R in the lower-order bits of the output data $Q_i$ as a result of comparison therebetween to output an L level signal, the AND gate $\mathbf{57}_i$ outputs an L level signal to the clock terminal of the i-th merge memory $\mathbf{66}_i$. Then, when the inverter 55 emits a pulse of the inverted signal IHs, the value held in the i-th merge memory $\mathbf{66}_i$ is held intact. On the other hand, the selector $\mathbf{58}_i$ selects the "0" terminal to output the input data $Dt_0$ to the (i+1)th merge memory $\mathbf{66}_{i+1}$ provided in the next stage. Since the count FLN_R stored in the (i+1)th merge memory $\mathbf{66}_{i+1}$ is greater than the count FLN_R included in the input data $Dt_0$, the comparator circuit $\mathbf{56}_{i+1}$ outputs an H level signal. Thus, when the inverter 55 emits the inverted signal IHs in the form of pulses, the (i+1)th merge memory $\mathbf{66}_{i+1}$ acquires and holds the data $Dt_i$ inputted from the selector $\mathbf{58}_i$.

In this manner, the count FLN_R included in the input data $Dt_0$ is compared by the comparator circuits $\mathbf{56}_1$ to $\mathbf{56}_n$ with the counts FLN_R stored in the merge memories $\mathbf{66}_1$ to $\mathbf{66}_n$ in parallel. If the count FLN_R in the lower-order bits of the input data $Dt_0$ is greater than any one of the counts FLN_R held in the first to (i−1)th merge memories $\mathbf{66}_1$ to $\mathbf{66}_{i-1}$ and is not greater than the count FLN_R held in the i-th merge memory $\mathbf{66}_i$, the input data $Dt_0$ is transmitted through the selector $\mathbf{58}_i$ to the (i+1)th merge memory $\mathbf{66}_{i+1}$ and held therein. The data held in the (i+1)th to (n−1)th merge memories $\mathbf{66}_{i+1}$ to $\mathbf{66}_{n-1}$ are shifted to the (i+2)th to n-th merge memories $\mathbf{66}_{i+2}$ to $\mathbf{66}_n$.

As described above, after the input data $Dt_0$ for one subframe is inputted to the rearranging circuit 60, the first to n-th merge memories $\mathbf{66}_1$ to $\mathbf{66}_n$ rearrange the counts FLN_R for one subframe in ascending order and hold the rearranged counts FLN_R therein. The remaining rearranging circuits 61 and 62 for the B and G subframes shown in FIG. 11 are identical in circuit arrangement and functionality with the rearranging circuit 60.

Next, as illustrated in FIG. 11, skip flag selection circuits 63, 64 and 65 acquire from the rearranging circuits 60, 61 and 62 the rearranged connected data the number of which equals the skip number SNO stored in the skip number register 42 in ascending order of the counts FLN_R, FLN_B and FLN_G, respectively. For example, if the skip number SNO is "4," the skip flag selection circuit 63 for R subframes acquires the output data $Q_1$ to $Q_4$ from the first to fourth merge memories $\mathbf{66}_1$ to $\mathbf{66}_4$ from the rearranging circuit 60 shown in FIG. 12.

Next, the skip flag selection circuits 63, 64 and 65 set the values of the skip flags SPF_Ri, SPF_Bi and SPF_Gi corresponding to the line number i in the higher-order bits of the data acquired from the rearranging circuits 60, 61 and 62, respectively, at "1," and sets the values of the other skip flags at "0." These skip flags SPF_R1 to SPF_Rn, SPF_B1 to SPF_Bn, and SPF_G1 to SPF_Gn are stored in skip flag registers 37, 38 and 39, respectively.

Then, as described in the first preferred embodiment, the timing controller 6 temporarily makes the cycle duration of the i-th pulse of the gate shift clock CTL0 shorter than the normal cycle duration and temporarily makes the cycle duration of the i-th pulse of the control clock signal CTL1 shorter than the normal cycle duration for the i-th line corresponding to the skip flags SPF_Ri, SPF_Bi and SPF_Gi having the value "1". This shortens the write time of the image for the R, B and G subframes in accordance with the value of the skip number SNO. Although the value of the skip number SNO is common to the R, B and G subframes in this preferred embodiment, individual values of the skip number SNO may be established for the R, B and G subframes.

In general, a liquid crystal display device of the field sequential scheme is prone to exhibit a so-called "color breakup" phenomenon such that a moving object is displayed in different positions between R, B and G subframes because the liquid crystal display panel 11 acquires and displays the R, B and G subframes in sequence. The second preferred embodiment can speed up the writing of image data for the R, B and G subframes at a constant rate to enhance a frame frequency, thereby ameliorating a deterrent to image quality such as the above-mentioned color breakup.

Third Preferred Embodiment

Figure 15:
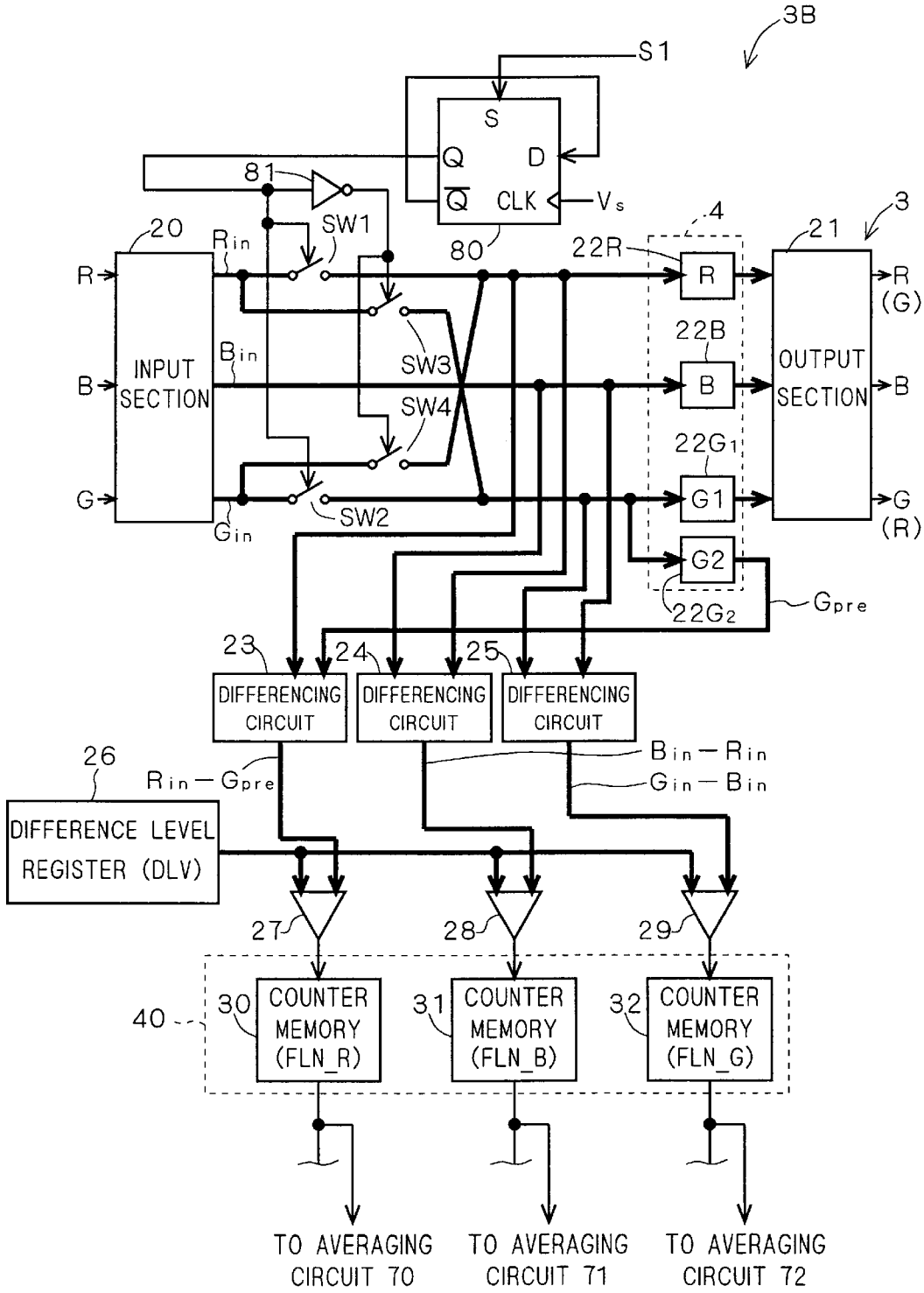
FIGS. 15 and 16 are schematic diagrams showing part of the image data processor of the liquid crystal display device according to a third preferred embodiment of the present invention.
Figure 16:
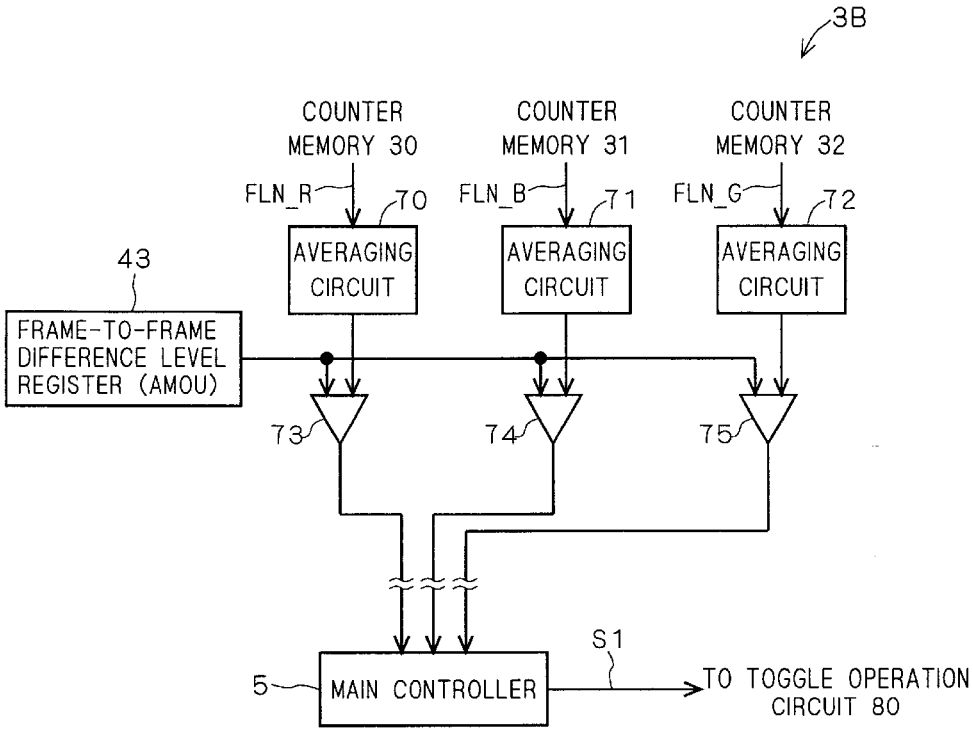

A third preferred embodiment according to the present invention will be described. FIGS. 15 and 16 are schematic diagrams showing part of an image data processor 3B of the liquid crystal display device according to the third preferred embodiment. Although not explicitly shown in FIG. 15, the image data processor 3B is similar in construction and functionality to the image data processor 3 or 3A of the first or second preferred embodiment.

As illustrated in FIG. 15, the image data processor 3B comprises a toggle operation circuit 80, and switches SW1 to SW4 toggled on/off depending on the signal level outputted from the toggle operation circuit 80. The toggle operation circuit 80 is a D flip-flop which is a toggled flip-flop in which data outputted from a $\overline{Q}$ terminal is fed back to a D terminal. The toggle operation circuit 80 outputs an H level signal from a Q terminal while the signal level of a display order switching signal S1 applied from the main controller 5 to an S terminal thereof is "H." In this state, the switch circuits SW1 and SW2 receive the H level signal from the toggle operation circuit 80 to turn on, whereas the switch circuits SW3 and SW4 receive an L level signal from an inverter 81 to turn off. The toggle operation circuit 80 inverts the signal level outputted from the Q terminal each time a vertical sync signal Vs is inputted thereto while the signal level of the display order switching signal S1 is "L." In this state, the switch circuits SW1, SW2 and the switch circuits SW3, SW4 are alternately turned on and off in a cycle of one frame.

While the signal level of the display order switching signal S1 is "H," the switch circuits SW1 and SW2 are on, and the display control method according to the first or second preferred embodiment is carried out. The counts FLN_R, FLN_B and FLN_G outputted from the counter memories 30, 31 and 32 are also provided to averaging circuits 70, 71 and 72, respectively, as illustrated in FIG. 16. The averaging circuits 70, 71 and 72 have the function of averaging the counts FLN_R, FLN_B and FLN_G for each subframe to output average values Av_R, Av_B and Av_G, respectively. The greater the difference between subframes, the greater the average values Av_R, Av_B and Av_G. Comparator circuits 73, 74, 75 compare the average values Av_R, Av_B and Av_G, respectively, with a frame-to-frame difference level AMOU stored in the register 43, and output an H level comparison signal when the former is greater than the latter. The comparison signal is transmitted to the main controller 5. If the main controller 5 receives the H level comparison signal a plurality of times in succession throughout a predetermined number of frames, the main controller 5 judges that the difference between subframes is large, and outputs the display order switching signal S1 at an L level to the toggle operation circuit 80 until the signal level of the comparison signal changes to "L."

The toggle operation circuit 80 outputs an H level signal and an L level signal alternately in a cycle of one frame from the Q terminal while the display order switching signal S1 at the L level is applied from the main controller 5 to the S terminal of the toggle operation circuit 80. Thus, the switch circuits SW1, SW2 and the switch circuits SW3, SW4 are alternately turned on and off in a cycle of one frame. This causes the output section 21 to sequentially output subframes in the display order: R, B, G, G, B, R, R, B, G, G, B, R, . . . .

Figure 17:
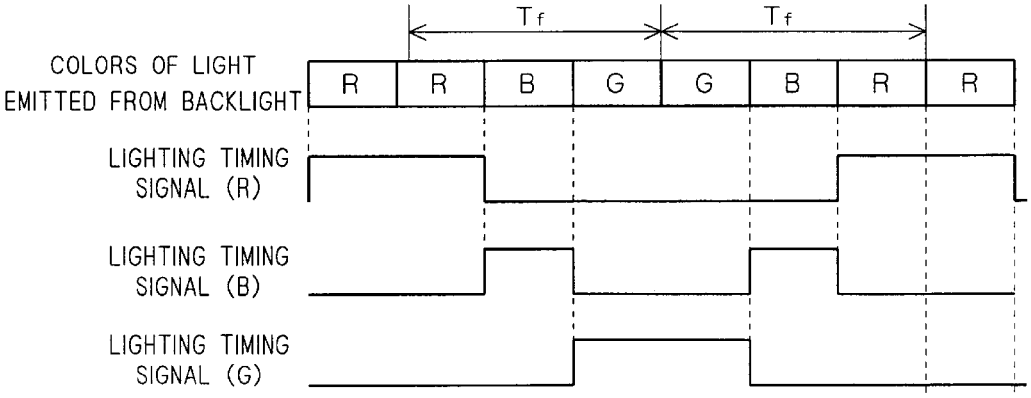
FIG. 17 is a timing chart showing the lighting timing of the backlight.

The backlight controller 7 receives the display order switching signal S1 at the L level from the main controller 5 to control the drive power supply 8 to change the order in which the backlight 12 turns on the light of the three colors according to the display order of subframes on a frame-by-frame basis. FIG. 17 is a timing chart showing the lighting timing of the backlight 12. This timing chart shows lighting timing signals of the R, B and G LEDs and the colors (R, B and G) of light emitted from the backlight 12. In FIG. 17, Tf indicates a frame display period. As depicted in FIG. 17, the order in which the light of the three colors is turned on is R, B, G, G, B, R, R, B, G, G, B, R, . . . where the R subframes and the G subframes are displayed in successive order. In general, a video signal supplied from a video signal source such as a personal computer has a tendency to show a small change but a strong correlation between a plurality of image data of the same color to be displayed in succession within a short time. Displaying the R subframes and the G subframes in successive order increase the display time of the image data of the same color to ameliorate the degradation of the image quality such as the lowering of contrast resulting from the response time of liquid crystal. Additionally, a shorter display period of the image data for B having a lower brightness relatively to R and G reduces screen flicker. On the other hand, when the difference between the subframes is small, the conventional display order of R, B and G may be repeated. This repeatedly displays the image data of the same color in a cycle of one frame, thereby preventing flicker resulting from the display color.

Fourth Preferred Embodiment

Figure 18:
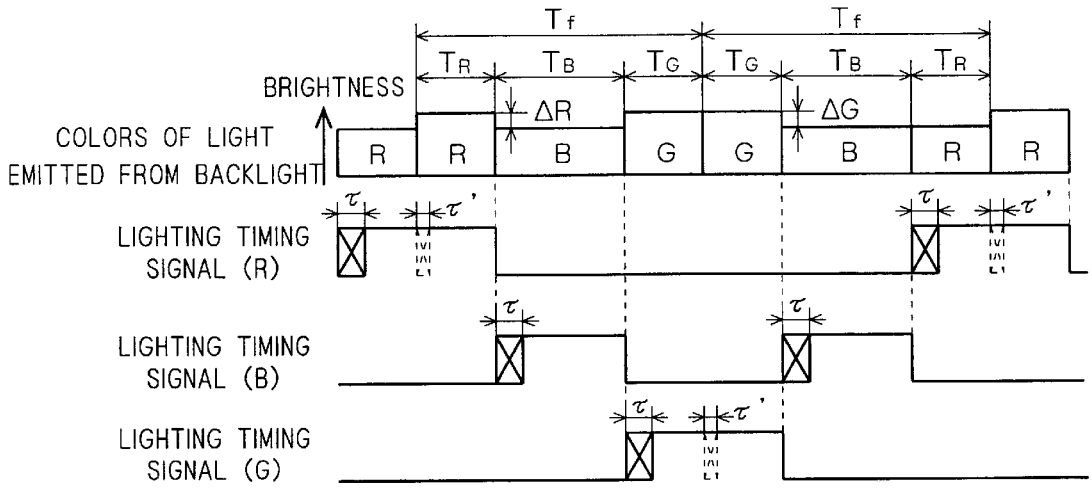
FIG. 18 is a timing chart for illustrating a display control method according to a fourth preferred embodiment of the present invention.

A display control method by the liquid crystal display device will be described according to a fourth preferred embodiment of the present invention. The display control method of the fourth preferred embodiment is premised on the construction of the liquid crystal display device of the third preferred embodiment. In the third preferred embodiment, the subframes of the same colors R and G are displayed in succession, as shown in FIG. 17. It is known that there is a small difference or a strong correlation between the subframes of the same color (R, R or G, G) displayed in succession in this manner. As illustrated in FIG. 18, the response time $\tau'$ of liquid crystal when displaying a timewise following one of the subframes of the same color (R, G) for successive display is substantially insignificant as compared with the response time $\tau$ of liquid crystal when displaying a timewise preceding one thereof. Therefore, shortening the display periods $T_R$ and $T_G$ of the subframes of the same color for successive display increases the frame frequency to ameliorate the deterrent to the image quality such as the above-mentioned color breakup. Similar effects can be produced by shortening only the display period of the timewise following one of the subframes of the same color for successive display.

However, thus shortening the display period of the subframes might decrease the brightness by the amount of reduction of the display period to result in a brightness imbalance between R, B and G. To prevent this, it is desirable to increase the brightness of R and G above the brightness of B or decrease the brightness of B below the brightness of R and G to adjust the brightness ratio between R, B and G. Thus adjusting the brightness ratio between R, B and G prevents flicker which is prone to occur when changing the display order of subframes in the third preferred embodiment.

Fifth Preferred Embodiment

In the first to fourth preferred embodiments, the backlight 12 is controlled to change between the colors R, G and B in succession to turn on the light of the colors R, G and B without interruption. Unfortunately, there arises a time difference between scanning the first scanning line and scanning the last scanning line of the liquid crystal display panel 11 by the gate driver circuit 9. The LEDs constituting the backlight 12 are controlled to turn on simultaneously for each color R, B and G. This presents a so-called "color mixing" problem such that as the scanning moves downwardly (toward the last line) of the liquid crystal display panel 11, the color of another subframe adjacent in display order is mixed with the current color to result in an improper color image. To avoid such a problem, a conventional method has attempted to provide an "off" period (dark period) between the "on" periods of the colors of the backlight 12. This method is required to turn on the backlight 12 at the time that the liquid crystal cells on all scanning lines of the liquid crystal display panel 11 have responded (or at the time that the polarizing angle of the liquid crystal is changed) to prevent uneven brightness of the upper and lower parts of the screen. This shortens the "on" period of the backlight 12 to lower the display brightness of the screen.

Figure 19:
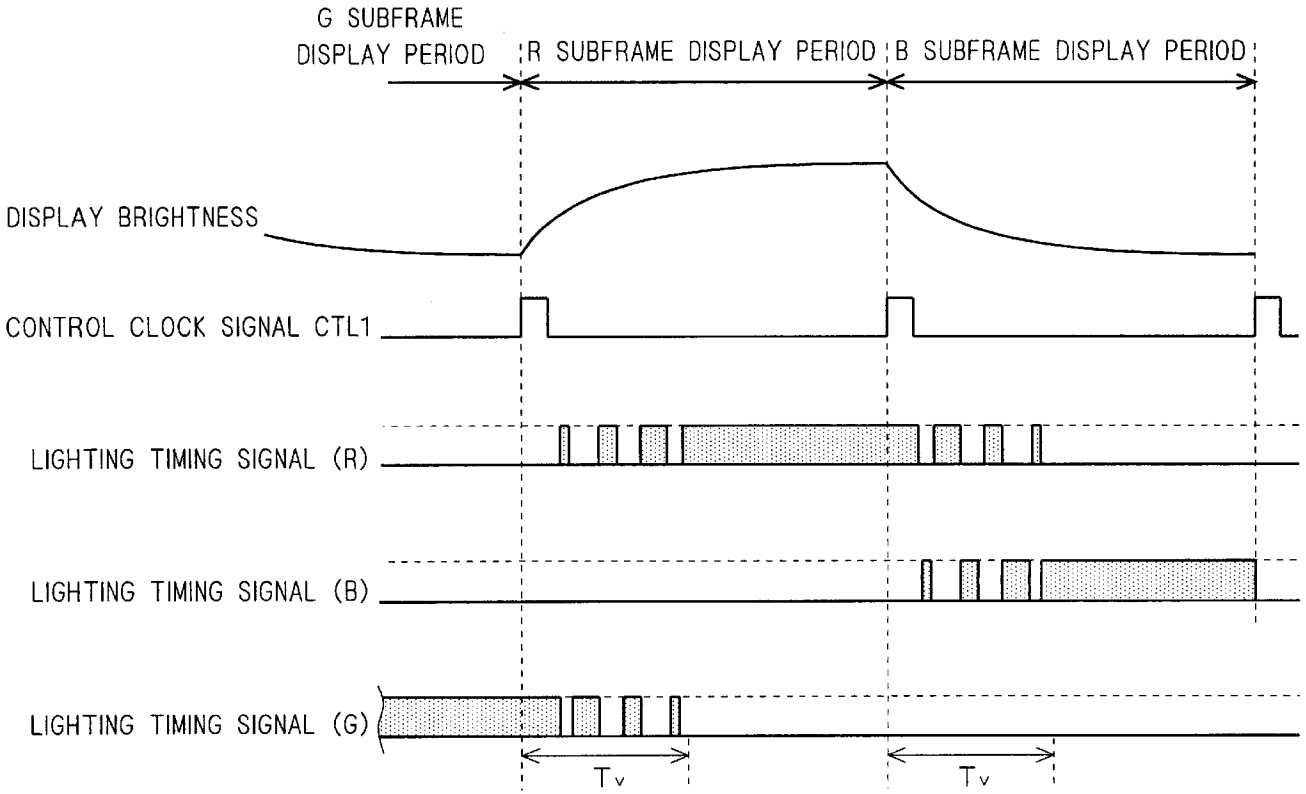
FIG. 19 is a timing chart for illustrating a display control method according to a fifth preferred embodiment of the present invention.

To prevent the lowering of the display brightness, a display control method according to a fifth preferred embodiment of the present invention turns on the light of the color of the current subframe of image data so that brightness gradually increases and turns on the light of the color of the immediately preceding subframe adjacent in display order so that brightness gradually decreases during the write period of the image data at least until all of the liquid crystal cells of the liquid crystal display panel 11 respond. FIG. 19 is a timing chart showing the lighting timing of the light of the three colors. The timing chart of FIG. 19 shows the lighting timing signals of the R, G and B LEDs, the above-mentioned control clock signal CTL1, and the display brightness of the screen.

The LEDs for the three colors of the backlight 12 are driven by PWM (pulse width modulated) pulses supplied from the drive power supply 8. The PWM pulses are generated at a frequency which is 20 to 100 times the frame frequency. As shown in FIG. 19, in the early stage of a R subframe display period (write period), control is exercised so that the duty ratio of the PWM pulses to be applied to the red LEDs gradually increases whereas the duty ratio of the PWM pulses to be applied to the green LEDs gradually decreases. In the early stage of a B subframe display period, control is exercised so that the duty ratio of the PWM pulses to be applied to the red LEDs gradually decreases whereas the duty ratio of the PWM pulses to be applied to the blue LEDs gradually increases.

Thus gradually changing the amount of LED light in the early stage of the display period of each subframe reduces the color mixing problem. Additionally, this method need not provide the conventional "off" period. This increases the proportion of the "on" periods of the backlight 12 in a cycle of one frame to increase the display brightness.

Changing the amplitude of the gray-scale voltage to be applied to the signal lines $D_1$ to $D_m$ in accordance with the image data produces a stepwise change in the brightness of the display image to achieve a gray-scale display (or half-tone display). In general, the response time $\tau_a$ of liquid crystal when producing a gray-scale display is shorter than the response time $\tau_b$ of liquid crystal when making a transition between a white display and a black display without the gray-scale display. In the third preferred embodiment, when the comparison signal at the H level is inputted a plurality of times in succession throughout a predetermined number of frames from the comparator circuits 73, 74 and 75 to the main controller 5, the main controller 5 judges that the difference between subframes is large and outputs the display order switching signal S1 at the L level, as illustrated in FIG. 16. With reference to FIG. 19, Tv denotes a time period for which the amount of LED light is gradually changed in corresponding relation to the subframe display period (write period) for each color. It is desirable that the main controller 5 controls the backlight controller 7 so that if the difference between subframes is judged to be large, the period Tv is set at less than the average value $<\tau>=(\tau_a+\tau_b)/2$ of the response time $\tau_a$ when producing the gray-scale display and the response time $\tau_b$ when making a transition between the white and black displays; otherwise the period Tv is set at equal to or greater than the average value $<\tau>$. This further reduces the aforementioned color mixing problem.

Sixth Preferred Embodiment

Like the display control method according to the fifth preferred embodiment, a display control method according to a sixth preferred embodiment of the present invention turns on the light of the color of the current subframe of image data so that the brightness gradually increases and turns on the light of the color of the immediately preceding subframe adjacent in display order so that the brightness gradually decreases during the write period of the image data at least until all of the liquid crystal cells of the liquid crystal display panel 11 respond. Although the drive pulses to be applied to the LEDs of the backlight 12 are generated by the PWM method according to the fifth preferred embodiment, a drive signal to be applied to the LEDs for the three colors is amplitude-modulated according to the sixth preferred embodiment. This controls the brightness level of the LEDs.

Figure 20:
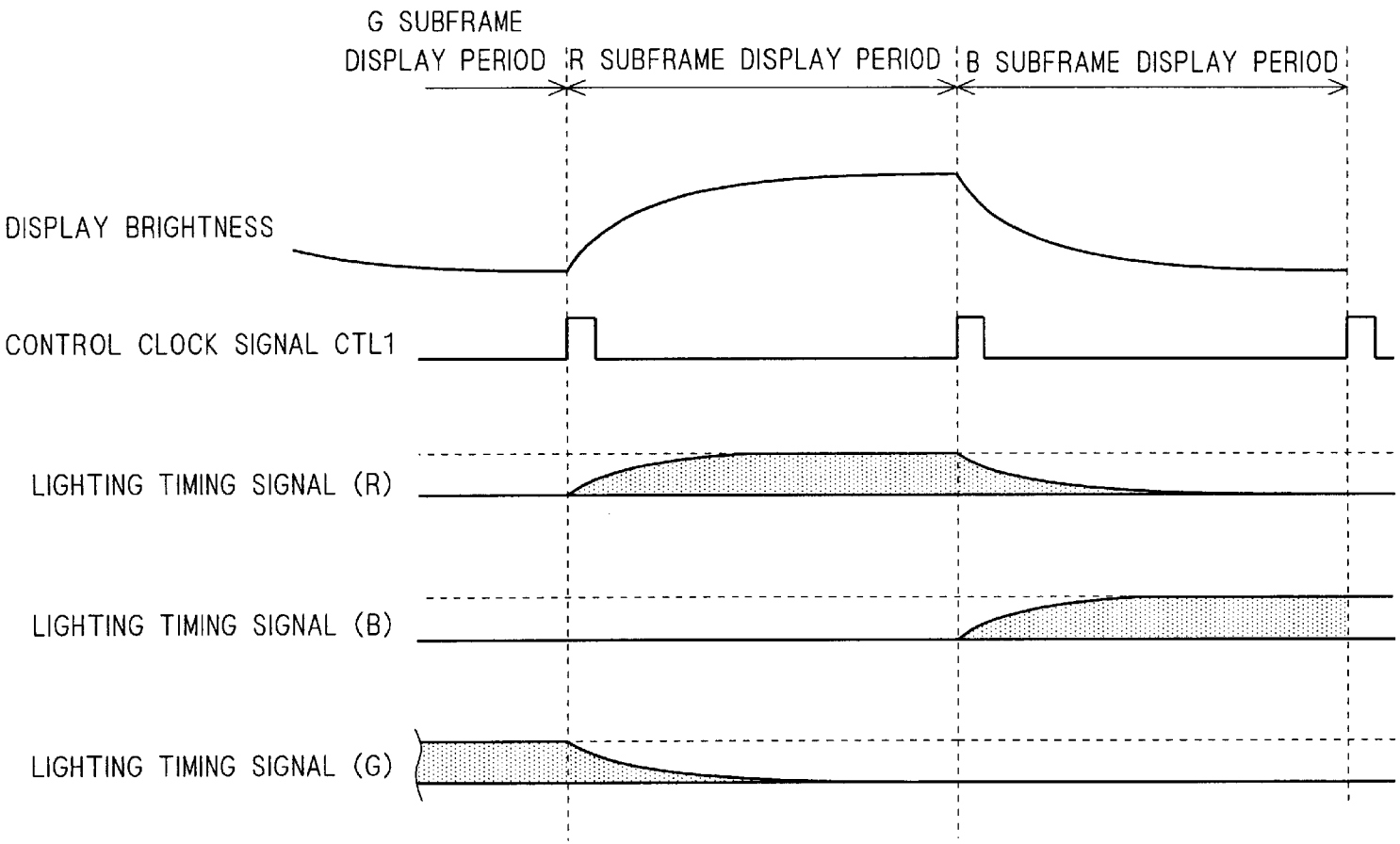
FIG. 20 is a timing chart for illustrating a display control method according to a sixth preferred embodiment of the present invention.

As illustrated in FIG. 20, in the early stage of the R subframe display period (write period), control is exercised so that the brightness level of the red LEDs gradually increases whereas the brightness level of the green LEDs gradually decreases. In the early stage of B subframe the display period, control is exercised so that the brightness level of the red LEDs gradually decreases whereas the brightness level of the blue LEDs gradually increases.

This display control method gradually changes the amount of LED light in the early stage of the display period of each subframe to reduce the color mixture problem, as in the fifth preferred embodiment. Additionally, this method need not provide the conventional "off" period. This increases the proportion of the "on" periods of the backlight 12 in a cycle of one frame to increase the display brightness. Moreover, the sixth preferred embodiment need not change between colors emitted from the backlight 12 at a high frequency, thereby to provide the advantage of suppressing noise generation.

Seventh Preferred Embodiment

A seventh preferred embodiment according to the present invention will be described. As stated above, the time difference occurs between scanning the first line and scanning the last line by the gate driver circuit 9. A discrepancy between this time difference and the lighting timing of the LEDs gives rise to the color mixing problem. A display control method according to the seventh preferred embodiment sequentially turns on the LEDs constituting the backlight in accordance with the driving speed of the gate driver circuit 9.

Figure 21:
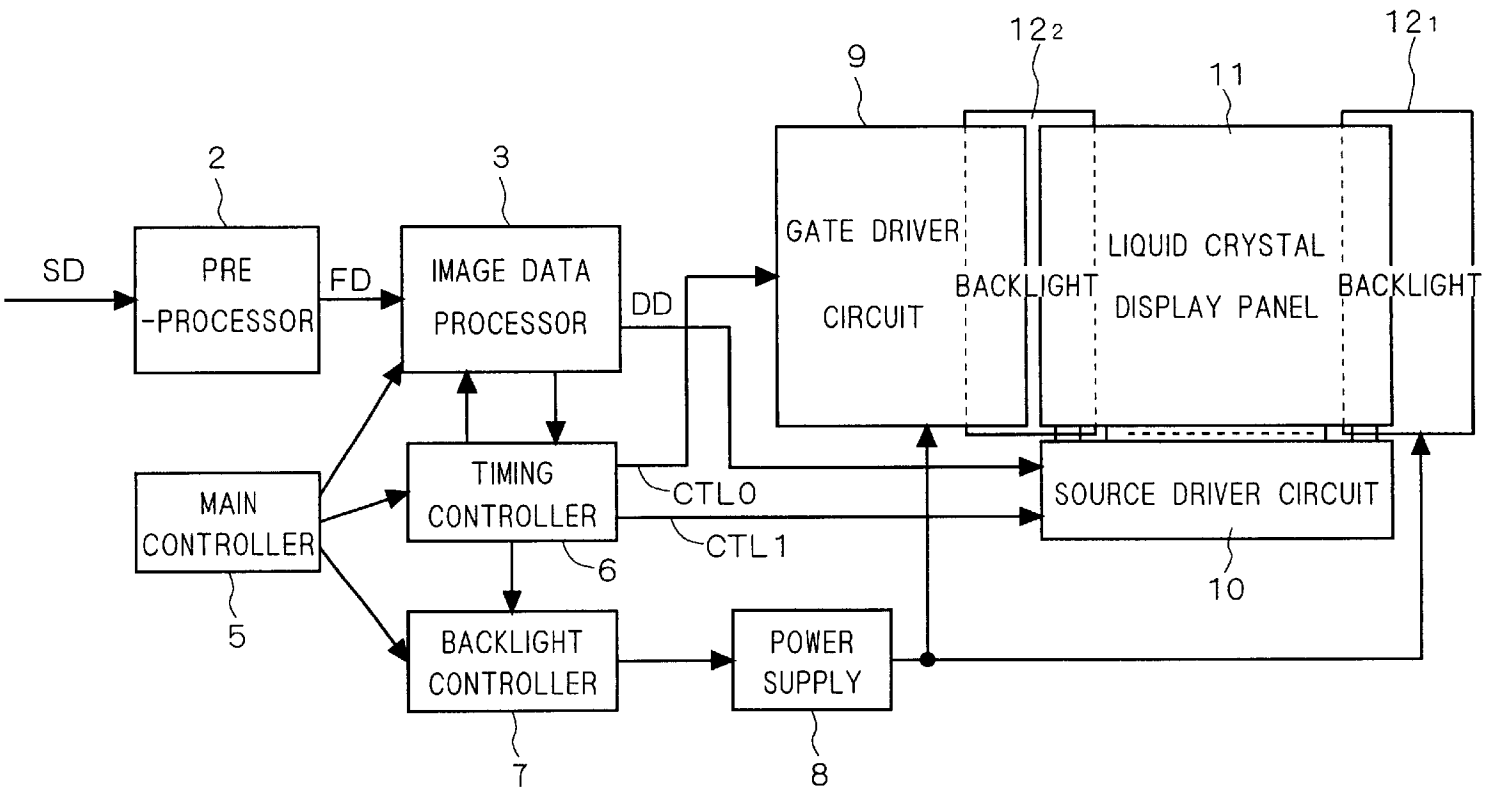
FIG. 21 is a schematic diagram of the liquid crystal display device according to a seventh preferred embodiment of the present invention.

FIG. 21 is a schematic diagram of a liquid crystal display device 1B according to the seventh preferred embodiment. The liquid crystal display device 1B differs from the liquid crystal display device 1 shown in FIG. 1 in comprising backlights $\mathbf{12}_1$, $\mathbf{12}_2$ disposed under opposite ends of the liquid crystal display panel 11 of the liquid crystal display device 1B according to the seventh preferred embodiment. The remaining structure of the liquid crystal display device 1B is substantially similar to the corresponding structure of the liquid crystal display device 1 shown in FIG. 1.

Figure 22:
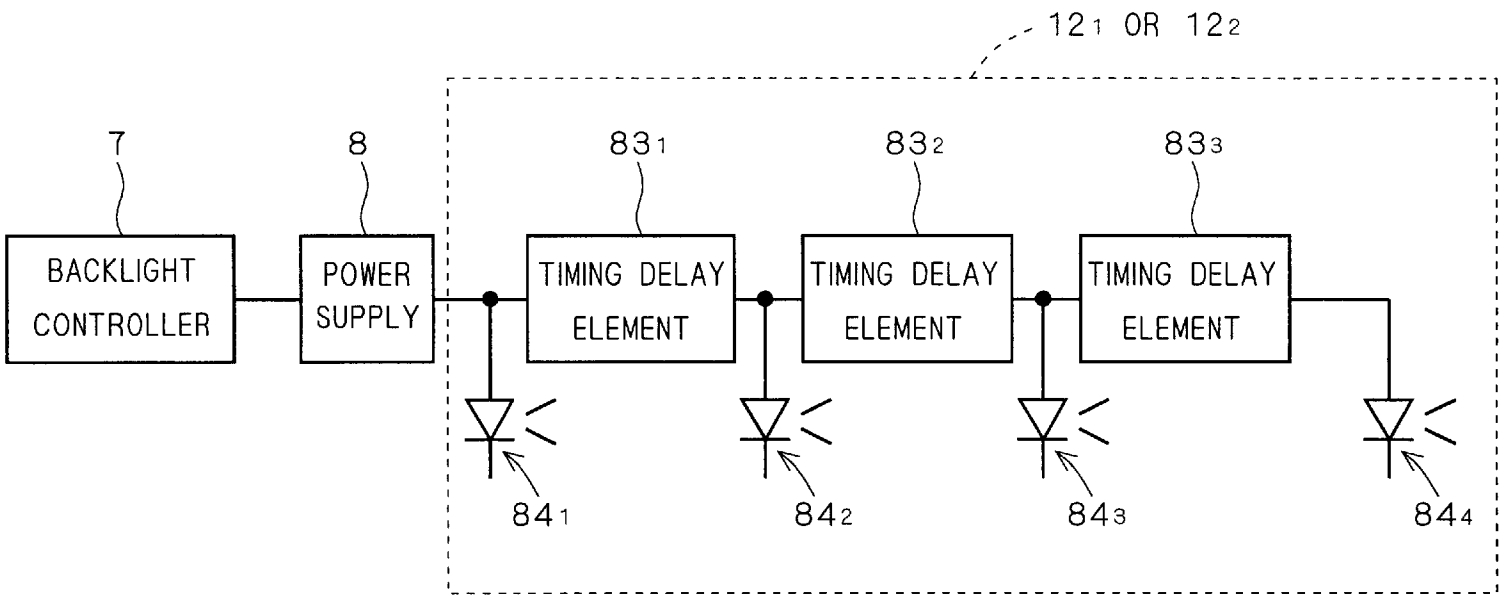
FIG. 22 is a schematic diagram showing an example of the backlight for use in the liquid crystal display device according to the seventh preferred embodiment.

FIG. 22 is a schematic diagram showing an example of the backlight $\mathbf{12}_1$ or $\mathbf{12}_2$. A group of LEDs constituting the backlight $\mathbf{12}_1$ or $\mathbf{12}_2$ are divided into four LED groups $\mathbf{84}_1$, $\mathbf{84}_2$, $\mathbf{84}_3$ and $\mathbf{84}_4$ disposed in the vertical pixel direction. The LED groups $\mathbf{84}_1$, $\mathbf{84}_2$, $\mathbf{84}_3$ and $\mathbf{84}_4$ are connected through timing delay elements $\mathbf{83}_1$, $\mathbf{83}_2$ and $\mathbf{83}_3$. The timing delay elements $\mathbf{83}_1$, $\mathbf{83}_2$ and $\mathbf{83}_3$ have the function of delaying the drive signal provided thereto from the drive power supply 8 by a predetermined delay time interval to output the delayed drive signal. Adjusting the delay time interval of the timing delay elements $\mathbf{83}_1$, $\mathbf{83}_2$ and $\mathbf{83}_3$ achieves sequential delays in turning on the LED groups $\mathbf{84}_1$, $\mathbf{84}_2$, $\mathbf{84}_3$ and $\mathbf{84}_4$ in timed relation to the application of the gate pulses to the scanning lines $S_1$ to $S_n$ by the gate driver circuit 9.

Figure 23:
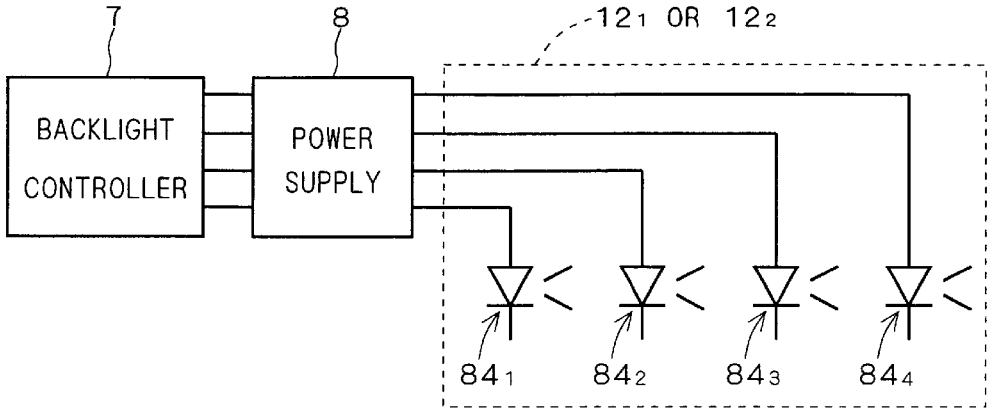
FIG. 23 is a schematic diagram showing another example of the backlight for use in the liquid crystal display device according to the seventh preferred embodiment.

FIG. 23 is a schematic diagram showing another example of the backlight $\mathbf{12}_1$ or $\mathbf{12}_2$. In the example shown in FIG. 23, a group of LEDs constituting the backlight $\mathbf{12}_1$ or $\mathbf{12}_2$ are divided into the four LED groups $\mathbf{84}_1$, $\mathbf{84}_2$, $\mathbf{84}_3$ and $\mathbf{84}_4$ to which individual drive signals are provided from the drive power supply 8 under the control of the backlight controller 7.

The divergence of a light beam emitted from each of the LED groups of the backlights $\mathbf{12}_1$ and $\mathbf{12}_2$ is limited.

Figure 24:
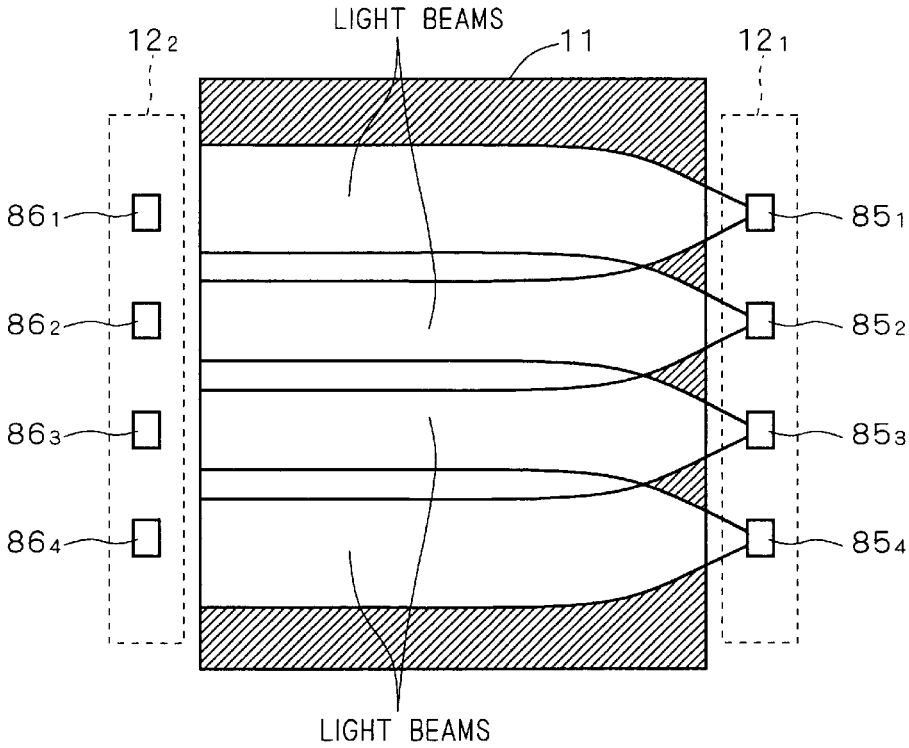
FIG. 24 is a schematic view showing the backlight for use in the liquid crystal display device according to the seventh preferred embodiment.
Figure 25:
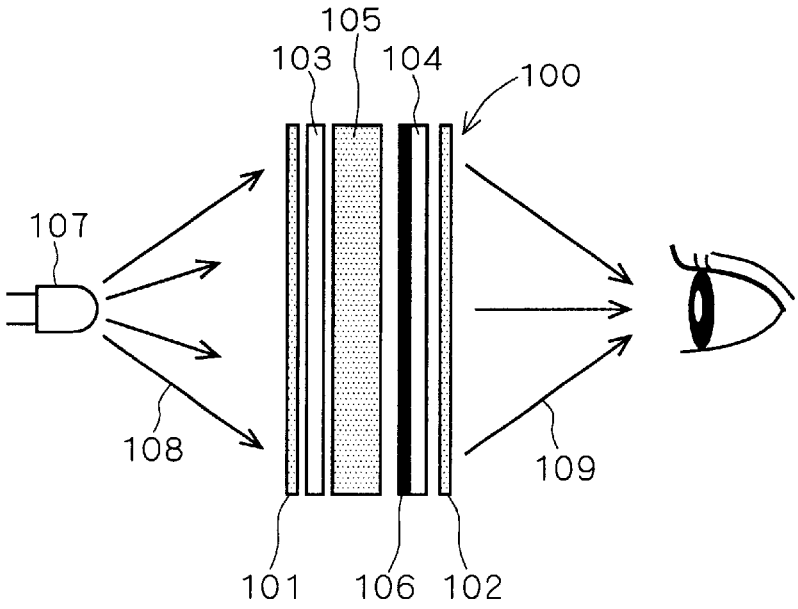
FIG. 25 is a schematic view showing a sectional structure of a background art liquid crystal panel for use in a transmissive liquid crystal display device.
Figure 26:
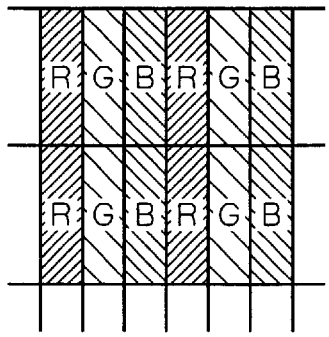
FIG. 26 is a schematic view showing an example of the arrangement of colored layers of a color filter.
Figure 31:
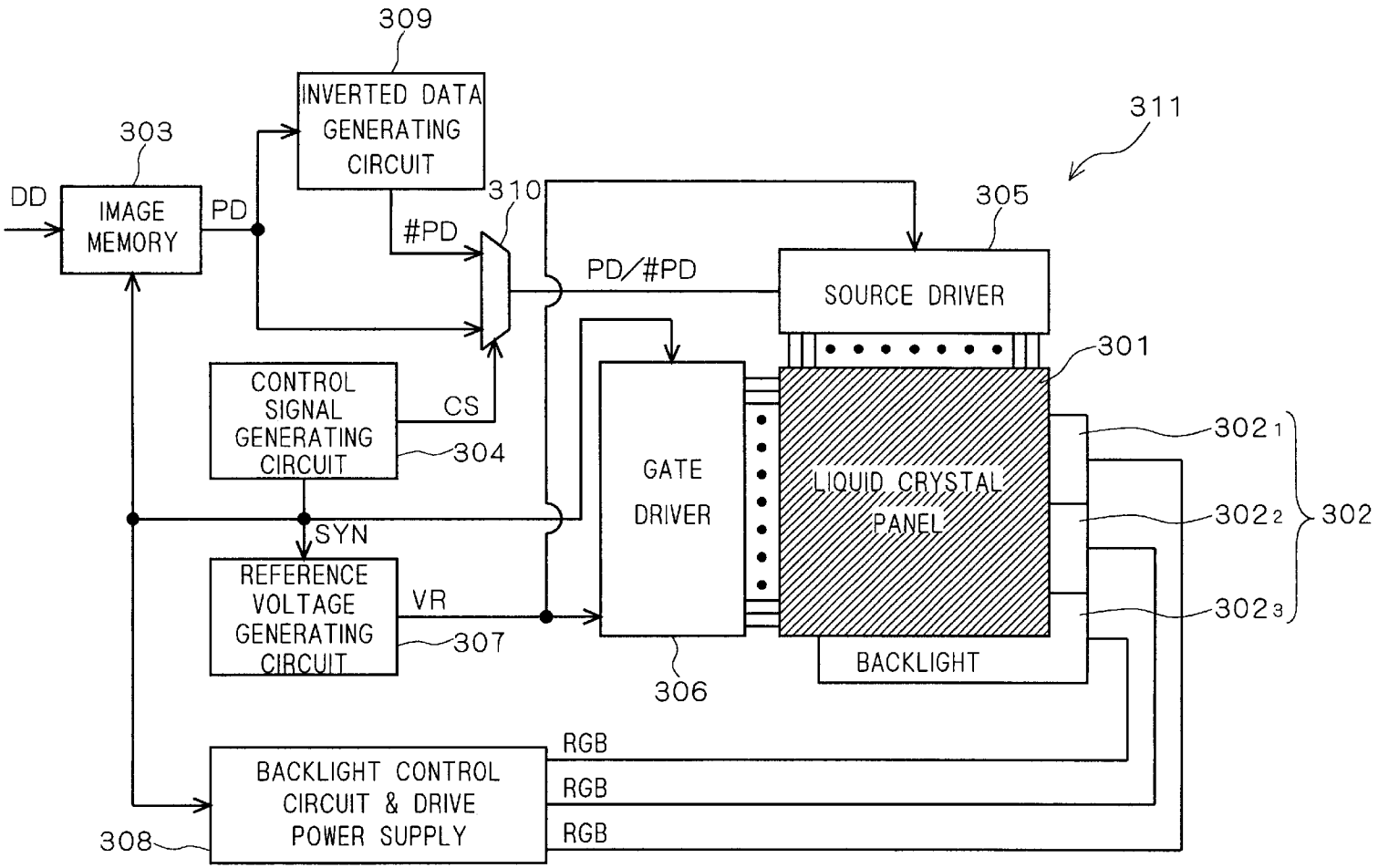
FIG. 31 is a schematic diagram of a liquid crystal display device disclosed in Japanese Patent Application Laid-Open No. 2000-147454.

Specifically, the divergence of the light beams emitted from respective LED groups $85_1$, $85_2$, $85_3$ and $85_4$ of the backlight $12_1$ is limited, as shown in FIG. 24. There is no particular restraint on methods of limiting the divergence of a beam of LED light. For example, a light-blocking plate, an optical lens or the like may be used to physically or optically limit an area illuminated by the LED light. The background art liquid crystal display device 311 shown in FIG. 31 has an optically light-blocking structure for dividing the light emission area of the backlight 302 into the plurality of blocks $302_1$, $302_2$ and $302_3$. However, since the liquid crystal pixels are very closely spaced, this kind of light-blocking structure must be provided very thin and accurately. Further, the light-blocking structure is required to withstand vibrations when transported, but it is difficult to achieve a light-blocking structure satisfying these requirements.

The constructions shown in FIGS. 22 and 23 can control the lighting delay time interval of the LED groups constituting the backlight $12_1$ or $12_2$, and limit the area illuminated by the LED light, to thereby further reducing the color mixing problem.

Although the LEDs constituting the backlight $12_1$ or $12_2$ are divided into the four LED groups in the seventh preferred embodiment, the present invention is not limited to this. In the light of reduction of the color mixing problem, it is preferable that the LEDs are divided into more LED groups. However, the greater the number of LED groups into which the LEDs are divided, the more complicated a circuit configuration and interconnection. Thus, it is practical to divide the LEDs into four to eight LED groups.

The liquid crystal display panel 11A shown in FIG. 10 may be employed as the liquid crystal display panel of the seventh preferred embodiment. In the light of reduction in lighting time difference between adjacent LED groups, it is desirable that the gate driver circuit $9_1$ of the upper structure 52 performs scanning from the upper end toward the center whereas the gate driver circuit $9_2$ of the lower structure 53 performs scanning from the lower end toward the center, and that the lighting timing of the LED groups constituting the backlights $12_1$ and $12_2$ is delayed in accordance with these scanning directions. This allows the reduction of the color mixing problem. The scanning by the gate driver circuits $9_1$ and $9_2$ and the turn-on of the LED groups may be performed in the reverse direction, i.e. from the center toward the upper and lower ends, rather than the upper and lower ends toward the center.

Eight Preferred Embodiment

For the liquid crystal display device according to the present invention, it is desirable to control the frame frequency at 60 Hz or higher to ameliorate the above-mentioned color mixing and flicker. This requires a liquid crystal response speed as high as 3 milliseconds ($=3\times10^{-3}$ seconds) or less. Examples of the liquid crystal having such a high response speed include ferroelectric liquid crystal and antiferroelectric liquid crystal which have a response speed of tens to hundreds of microseconds. However, ferroelectric liquid crystal and antiferroelectric liquid crystal present many problems in point of the image quality when producing a gray-scale display and mass production, as compared with nematic liquid crystal.

Considering these problems, it is desirable for the liquid crystal display device according to the first to seventh preferred embodiment to employ an OCB (Optically Self-Compensated Birefringence) mode using the bend alignment of nematic liquid crystal according to an eight preferred embodiment of the present invention. The term "bend alignment" means a state in which liquid crystal in its upper and lower halves disposed along the thickness of a liquid crystal layer is symmetrically aligned and optically self-compensated. The OCB mode allows a high-speed response of 3 milliseconds or less also when making a transition between gray-scale levels. The bend alignment is disclosed, for example, in "P. J. Boss and J. A. Rahman: SID 1993 Dig., P. 273 (1993)," and "Y. Yamaguchi, T. Miyashita and T. Uchida: SID 1993 Dig., P. 277 (1993)."

While the invention has been described in detail, the foregoing description is in all aspects illustrative and not restrictive. It is understood that numerous other modifications and variations can be devised without departing from the scope of the invention.

What is claimed is:

1. A liquid crystal display device comprising:

a transmissive liquid crystal display panel devoid of any color filter;

an image data processor for converting one frame of an image including a plurality of color components into a plurality of subframes each consisting of a single color component to output said subframes in predetermined order;

a driver circuit for driving said liquid crystal display panel based on said subframes received from said image data processor;

a backlight for illuminating a backside of said liquid crystal display panel, and including a light source for emitting light of a plurality of colors;

a backlight controller for controlling said backlight to turn on to emit light of a color corresponding to a color component of each of said subframes in a time-shared manner in synchronism with the time at which said driver circuit writes each of said subframes into said liquid crystal display panel;

a judging circuit for calculating difference data between adjacent ones of said subframes which are successive in display order on a pixel-by-pixel basis to judge whether or not there is a subframe-to-subframe difference therebetween on a line-by-line basis, based on said difference data for one line; and a controller for temporarily shortening a write cycle duration of a clock for defining the timing of writing of image data for a line judged by said judging circuit to be devoid of the subframe-to-subframe difference into said liquid crystal display panel, wherein said driver circuit reduces a pulse width of an address signal to be applied to a scanning line of said liquid crystal display panel in accordance with said write cycle duration.

2. The liquid crystal display device according to claim 1, wherein said write cycle duration of the clock for defining the timing of writing of the image data for the line judged to be devoid of the subframe-to-subframe difference into said liquid crystal display panel is set to a duration long enough to provide the same amount of electric charge as discharged to said liquid crystal display panel.

3. The liquid crystal display device according to claim 1, further comprising a second controller for specifying a predetermined number of lines for which said write cycle duration is temporarily shortened in ascending order of the subframe-to-subframe difference.

4. The liquid crystal display device according to claim 1, further comprising a second judging circuit for judging whether or not the subframe-to-subframe difference throughout a predetermined number of frames is large, wherein said image data processor outputs said subframes so that at least one set of said subframes consisting of the same color component are successive in display order during a period during which said second judging circuit judges that the subframe-to-subframe difference is large.

5. The liquid crystal display device according to claim 4, wherein a display period of subframes consisting of the same color component which are successive in display order is shortened.

6. The liquid crystal display device according to claim 5, wherein a brightness of said backlight corresponding to said subframes whose display period is shortened is increased.

7. The liquid crystal display device according to claim 1, wherein during a period during which liquid crystal cells of said liquid crystal display panel respond by writing of one of said subframes, said backlight controller turns on light corresponding to a color component of said one subframe so that brightness gradually increases, and turns on light corresponding to a color component of its immediately preceding subframe adjacent in display order so that brightness gradually decreases.

8. The liquid crystal display device according to claim 7, wherein a drive signal provided to said backlight is a PWM (pulse width modulated) signal.

9. The liquid crystal display device according to claim 7, wherein a drive signal provided to said backlight is an amplitude-modulated signal.

10. The liquid crystal display device according to claim 1, wherein said backlight includes a plurality of light sources arranged in corresponding relation to scanning lines of said liquid crystal display panel, and said backlight controller controls said plurality of light sources to sequentially delay the lighting timing of said plurality of light sources in accordance with the driving speed of said driver circuit.

11. The liquid crystal display device according to claim 1, wherein said liquid crystal display panel has an OCB (Optically Self-Compensated Birefringence) mode using bend alignment of nematic liquid crystal.

* * * * *